US009696641B2

(12) United States Patent
Iwashita et al.

(10) Patent No.: US 9,696,641 B2
(45) Date of Patent: Jul. 4, 2017

(54) ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Yuko Iwashita, Osaka (JP); Kazutaka Sugimoto, Osaka (JP); Takafumi Matsumoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/010,098

(22) Filed: Jan. 29, 2016

(65) Prior Publication Data

US 2016/0223921 A1 Aug. 4, 2016

(30) Foreign Application Priority Data

Feb. 2, 2015 (JP) ..... 2015-018874

(51) Int. Cl.
*G03G 5/047* (2006.01)
*G03G 5/06* (2006.01)

(52) U.S. Cl.
CPC ..... *G03G 5/047* (2013.01); *G03G 5/0614* (2013.01); *G03G 5/0672* (2013.01); *G03G 5/0696* (2013.01)

(58) Field of Classification Search
CPC ..... G03G 5/0696; G03G 5/0614; G03G 15/00
See application file for complete search history.

(56) References Cited

U.S. PATENT DOCUMENTS 7,855,286 B2 12/2010 Otsubo et al.
2003/0190540 A1* 10/2003 Shoshi ..... C07D 209/58 430/78

(Continued)

FOREIGN PATENT DOCUMENTS

EP 1788037 A1 5/2007
EP 1788037 * 1/2013 ..... G03G 5/06

(Continued)

OTHER PUBLICATIONS

Translation of JP 2005-140948.*

(Continued)

*Primary Examiner* — Peter Vajda
(74) *Attorney, Agent, or Firm* — Studebaker & Brackett PC

(57) ABSTRACT

An electrophotographic photosensitive member includes a photosensitive layer. The photosensitive layer contains a charge generating material and a hole transport material represented by general formula (1) shown below in a single layer. Titanyl phthalocyanine contained as the charge generating material exhibits a main peak at a Bragg angle $2\theta \pm 0.2° = 27.2°$ in a CuKα characteristic X-ray diffraction spectrum and satisfies either (B) or (C), shown below, in a differential scanning calorimetry spectrum. (B) A peak is not present in a range from 50° C. to 400° C., other than a peak resulting from vaporization of adsorbed water. (C) A peak is not present in a range from 50° C. to 270° C., other than a peak resulting from vaporization of adsorbed water, and a peak is present in a range from 270° C. to 400° C.

(Continued)

(1)

9 Claims, 6 Drawing Sheets

(56) References Cited

U.S. PATENT DOCUMENTS

2007/0054209 A1* 3/2007 Azuma ..... G03G 5/0517 430/73
2007/0111123 A1 5/2007 Otsubo et al.
2009/0304411 A1* 12/2009 Mochizuki ..... G03G 15/0131 399/101
2010/0081073 A1 4/2010 Otsubo et al.

FOREIGN PATENT DOCUMENTS

JP 2005-140948 * 2/2005 ..... G03G 5/06
JP 2006-284679 A 10/2006
JP 2007-011073 A 1/2007
JP 2008-145708 A 6/2008
JP 2008-152232 A 7/2008

OTHER PUBLICATIONS

The extended European search report issued by the European Patent Office on May 31, 2016, which corresponds to European Patent Application No. 16152686.8-1303 and is related to U.S. Appl. No. 15/010,098.

An Office Action; "Notice of Reasons for Rejection," issued by the Japanese Patent Office on Jul. 12, 2016, which corresponds to Japanese Patent Application No. 2015-018874 and is related to U.S. Appl. No. 15/010,098.

* cited by examiner

ELECTROPHOTOGRAPHIC PHOTOSENSITIVE MEMBER, PROCESS CARTRIDGE, AND IMAGE FORMING APPARATUS

INCORPORATION BY REFERENCE

The present application claims priority under 35 U.S.C. §119 to Japanese Patent Application No. 2015-018874, filed on Feb. 2, 2015. The contents of this application are incorporated herein by reference in their entirety.

BACKGROUND

The present disclosure relates to an electrophotographic photosensitive member, a process cartridge, and an image forming apparatus.

An electrophotographic image forming apparatus (for example, a printer or a multifunction peripheral) includes an electrophotographic photosensitive member as an image bearing member. The electrophotographic photosensitive member typically includes a conductive substrate and a photosensitive layer located either directly or indirectly on the conductive substrate. A photosensitive member such as described above that includes a photosensitive layer containing a charge generating material, a charge transport material (for example, a hole transport material), and a resin (organic material) for binding the aforementioned materials is referred to as an organic electrophotographic photosensitive member.

Among such organic electrophotographic photosensitive members, an organic electrophotographic photosensitive member that contains a charge transport material and a charge generating material in the same layer and implements functions of charge generation and charge transport through the same layer is referred to as a single-layer electrophotographic photosensitive member.

In recent years, progress has been made, not only in development of monochrome image forming apparatuses, but also in development of color image forming apparatuses. There has also been progress in providing smaller and faster image forming apparatuses. As a consequence of such progress, an electrophotographic photosensitive member is required to have high sensitivity in order to be compatible with a high-speed process. However, in a situation in which an electrophotographic photosensitive member is used while exposed to a gas of an oxidizing substance (for example, ozone) or a gas of a nitrogen oxide (for example, NOx) and particularly in a situation in which the electrophotographic photosensitive member is used repeatedly, a problem of reduced sensitivity of the electrophotographic photosensitive member tends to occur.

In one known example, an image forming apparatus includes an electrophotographic photosensitive member that contains at least a diarylamine compound in an outermost layer.

In another known example, an electrophotographic apparatus includes an electrophotographic photosensitive member that includes a photosensitive layer containing a triphenylamine charge mobilizer (charge transport material) and a charge generating material composed of oxytitanium phthalocyanine (titanyl phthalocyanine).

SUMMARY

An electrophotographic photosensitive member according to the present disclosure includes a conductive substrate and a photosensitive layer located either directly or indirectly on the conductive substrate. The photosensitive layer contains at least a charge generating material, a hole transport material, an electron transport material, and a binder resin in the same layer. The hole transport material includes a compound represented by general formula (1) shown below. The charge generating material includes titanyl phthalocyanine. The titanyl phthalocyanine exhibits a main peak at a Bragg angle 2θ±0.2°=27.2° in a CuKα characteristic X-ray diffraction spectrum. The titanyl phthalocyanine satisfies either (B) or (C), shown below, in a differential scanning calorimetry spectrum.

(B) A peak is not present in a range from 50° C. to 400° C., other than a peak resulting from vaporization of adsorbed water.

(C) A peak is not present in a range from 50° C. to 270° C., other than a peak resulting from vaporization of adsorbed water, and a peak is present in a range from 270° C. to 400° C.

(1)

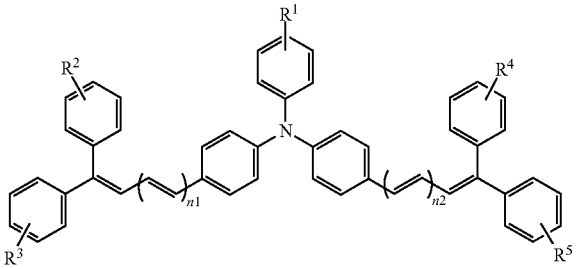

In general formula (1), $R^1$, $R^2$, $R^3$, $R^4$, and $R^5$ each represent, independently of one another, an optionally substituted alkyl group, an optionally substituted alkoxy group, an optionally substituted aryl group, an optionally substituted aryloxy group, an optionally substituted aralkyl group, a halogen atom, or a hydrogen atom. In general formula (1), n1 and n2 each represent, independently of one another, an integer of at least 0 and no greater than 4.

A process cartridge according to the present disclosure includes the electrophotographic photosensitive member described above.

An image forming apparatus according to the present disclosure includes an image bearing member, a charging section, a light exposure section, a developing section, and a transfer section. The image bearing member is the electrophotographic photosensitive member described above. The charging section charges a surface of the image bearing member. The charging section has a positive charging polarity. The light exposure section forms an electrostatic latent image on the surface of the image bearing member by exposing the surface of the image bearing member to light after the surface of the image bearing member is charged by the charging section. The developing section develops the electrostatic latent image into a toner image. The transfer section transfers the toner image onto a transfer target from the image bearing member.

DETAILED DESCRIPTION

The following explains embodiments of the present disclosure in detail. However, the present disclosure is not limited in any way by the following embodiments and may be implemented with appropriate alterations within the intended scope of the present disclosure. Note that although explanation is omitted as appropriate in some places in order to avoid repetition, such omission does not limit the essence of the present disclosure.

First Embodiment: Electrophotographic Photosensitive Member

Figure 1A:
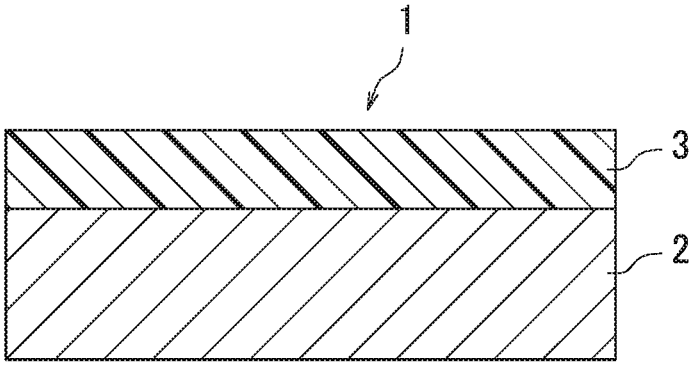
FIGS. 1A, 1B, and 1C are schematic cross-sectional views each illustrating structure of an electrophotographic photosensitive member according to a first embodiment.
Figure 1B:
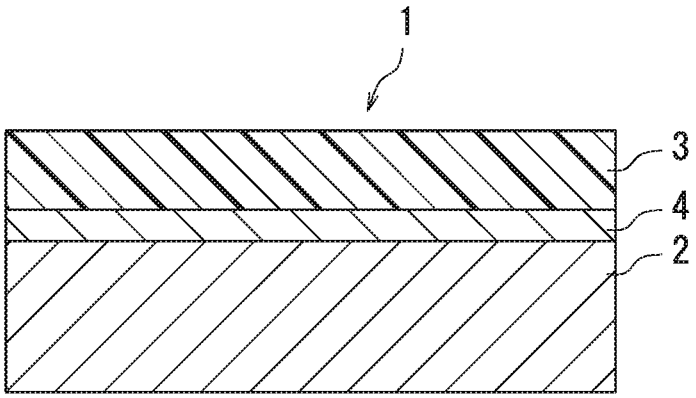
Figure 1C:
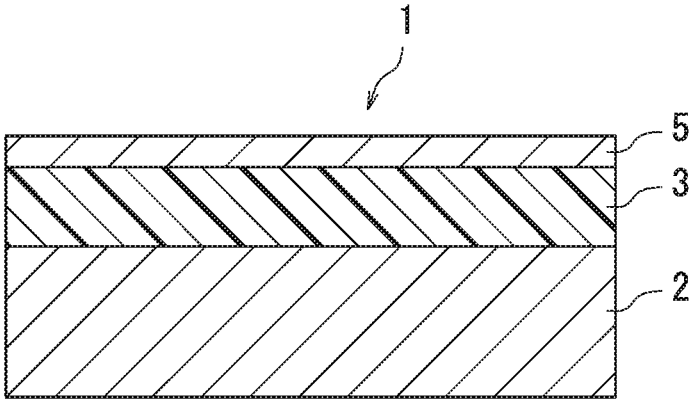

A first embodiment relates to an electrophotographic photosensitive member (also referred to below as a photosensitive member). The following explains the photosensitive member according to the present embodiment with reference to FIGS. 1A, 1B, and 1C. FIGS. 1A, 1B, and 1C are schematic cross-sectional views illustrating structure of the electrophotographic photosensitive member according to the first embodiment.

The photosensitive member 1 includes a conductive substrate 2 and a photosensitive layer 3. The photosensitive layer 3 is located either directly or indirectly on the conductive substrate 2. The photosensitive layer 3 includes at least a charge generating material, a hole transport material, an electron transport material, and a binder resin in the same layer.

The photosensitive layer 3 contains titanyl phthalocyanine (also referred to below as Y-form titanyl phthalocyanine crystals) having the following optical and thermal characteristics as the charge generating material.

Optical characteristic: Main peak at a Bragg angle $2\theta \pm 0.2° = 27.2°$ in a CuKα characteristic X-ray diffraction spectrum Thermal characteristic: Satisfying either (B) or (C), shown below, in a differential scanning calorimetry spectrum (B) A peak is not present in a range from 50° C. to 270° C., other than a peak resulting from vaporization of adsorbed water.

(C) A peak is not present in a range from 50° C. to 270° C., other than a peak resulting from vaporization of adsorbed water, and at least one peak is present in a range from 270° C. to 400° C.

The Y-form titanyl phthalocyanine crystals have excellent dispersibility in the photosensitive layer 3. Therefore, in a configuration in which the photosensitive layer 3 contains the Y-form titanyl phthalocyanine crystals as the charge generating material, the photosensitive member 1 including the photosensitive layer 3 tends to have an improved charge retention rate.

The photosensitive layer 3 contains a compound represented by general formula (1) (also referred to below as hole transport material (1)) as the hole transport material. Interactions between π-electrons of aromatic rings in the hole transport material (1) and π-electrons of aromatic rings in the Y-form titanyl phthalocyanine crystals are thought to reduce intermolecular distances between the hole transport material (1) and the Y-form titanyl phthalocyanine crystals. It is thought that as a result of the above, contact surface area of the Y-form titanyl phthalocyanine crystals and the hole transport material (1) in the photosensitive layer 3 increases. An increase in the contact surface area tends to lead to improved charge injection from the Y-form titanyl phthalocyanine crystals to the hole transport material (1) (i.e., ease of charge acceptance by the hole transport material (1)). More specifically, the hole transport material (1) tends to more readily accept free charge present in the Y-form titanyl phthalocyanine crystals after the Y-form titanyl phthalocyanine crystals absorb laser light. The hole transport material (1) also tends to have a high charge retention rate, which in combination with improved charge injection properties, makes it easier to inhibit charge trapping. As a result, it is possible to inhibit a reduction in charge potential of the surface of the photosensitive member 1 from occurring in a state in which the surface of the photosensitive member 1 is exposed to a gas of an oxidizing substance (for example, ozone) or a nitrogen oxide (for example, NOx). Furthermore, it is possible to inhibit a reduction in charge potential of the surface of the photosensitive member 1 from occurring in a situation in which the photosensitive member 1 is used repeatedly.

The photosensitive layer 3 is located either directly or indirectly on the conductive substrate 2 as explained further above. The photosensitive layer 3 is for example located directly on the conductive substrate 2 as illustrated in FIG. 1A. Alternatively, an intermediate layer 4 may for example be provided as appropriate between the conductive substrate 2 and the photosensitive layer 3 as illustrated in FIG. 1B. The photosensitive layer 3 may be exposed as an outermost layer as illustrated in FIGS. 1A and 1B. Alternatively, a protective layer 5 may be provided as appropriate on the photosensitive layer 3 as illustrated in FIG. 1C.

No specific limitations are placed on the thickness of the photosensitive layer 3 other than enabling the photosensitive layer 3 to function sufficiently as a photosensitive layer. The thickness of the photosensitive layer 3 is for example at least 5 μm and no greater than 100 μm, and preferably at least 10 μm and no greater than 50 μm.

The following explains the conductive substrate 2 and the photosensitive layer 3. The intermediate layer 4 is also explained.

[1. Conductive Substrate]

No specific limitations are placed on the conductive substrate 2 other than being a conductive substrate that can be used in the photosensitive member 1. The conductive substrate 2 can be a conductive substrate of which at least a surface portion thereof is made from a conductive material. Examples of the conductive substrate 2 include a conductive substrate made from a conductive material and a conductive substrate having a conductive material coating. Examples of conductive materials that can be used include aluminum, iron, copper, tin, platinum, silver, vanadium, molybdenum, chromium, cadmium, titanium, nickel, palladium, indium, stainless steel, and brass. Any one of the conductive materials listed above may be used or a combination of any two or more of the conductive materials listed above (for example, an alloy) may be used. Among the conductive materials listed above, aluminum or an aluminum alloy is preferable in terms of favorable charge mobility from the photosensitive layer 3 to the conductive substrate 2.

The shape of the conductive substrate 2 may be selected as appropriate to match the structure of an image forming apparatus in which the conductive substrate 2 is to be used. For example, a sheet-shaped conductive substrate or a drum-shaped conductive substrate can be used. The thickness of the conductive substrate 2 can be selected as appropriate in accordance with the shape of the conductive substrate 2.

[2. Photosensitive Layer]

As explained above, the photosensitive layer 3 contains the charge generating material, the hole transport material, the electron transport material, and the binder resin. The following explains the charge generating material, the hole transport material, the electron transport material, and the binder resin contained in the photosensitive layer 3. External additives that may optionally be contained in the photosensitive layer 3 as necessary are also explained.

[2-1. Charge Generating Material]

As explained above, the photosensitive layer 3 contains the Y-form titanyl phthalocyanine crystals as the charge generating material. In order that the photosensitive layer 3 has stable and excellent electrical characteristics, it is preferable that the photosensitive layer 3 is substantially composed of the Y-form titanyl phthalocyanine crystals. The Y-form titanyl phthalocyanine crystals can for example be represented by chemical formula (TiOPc).

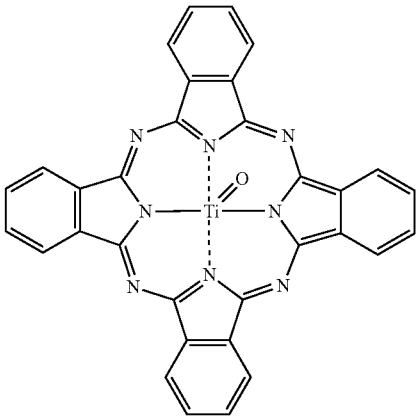

(TiOPc)

The photosensitive layer 3 may contain another charge generating material, in addition to the Y-form titanyl phthalocyanine crystals, as the charge generating material. Examples of other charge generating materials that can be used include phthalocyanine-based pigments, perylene pigments, bisazo pigments, dithioketopyrrolopyrrole pigments, metal-free naphthalocyanine pigments, metal naphthalocyanine pigments, squaraine pigments, tris-azo pigments, indigo pigments, azulenium pigments, cyanine pigments, powders of inorganic photoconductive materials such as selenium, selenium-tellurium, selenium-arsenic, cadmium sulfide, and amorphous silicon, pyrylium salts, anthanthrone-based pigments, triphenylmethane-based pigments, threne-based pigments, toluidine-based pigments, pyrazoline-based pigments, and quinacridone-based pigments. Examples of phthalocyanine-based pigments that can be used include metal-free phthalocyanine, titanyl phthalocyanine crystals having a crystal structure other than Y-form (specific examples include α-form titanyl phthalocyanine and β-form titanyl phthalocyanine), and phthalocyanine crystals having a metal other than titanium oxide as a coordination center (specific examples include V-form hydroxygallium phthalocyanine).

The Y-form titanyl phthalocyanine crystals exhibit a main peak at a Bragg angle (2θ±0.2°) of 27.2° in a CuKα characteristic X-ray diffraction spectrum. The Y-form titanyl phthalocyanine crystals may exhibit a peak other than at the Bragg angle 2θ±0.2°=27.2°. The Y-form titanyl phthalocyanine crystals preferably do not exhibit a peak at a Bragg angle (2θ±0.2°) of 26.2° in the CuKα characteristic X-ray diffraction spectrum. Note that the term "main peak" refers to a peak in the CuKα characteristic X-ray diffraction spectrum having a highest or second highest intensity in a range of Bragg angles (2θ±0.2°) from 3° to 40°.

The Y-form titanyl phthalocyanine crystals having the aforementioned X-ray diffraction characteristic (main peak: 27.2°) are classified into two types based on a difference in thermal characteristics measured by DSC (more specifically, thermal characteristics (B) and (C) shown below).

(B) In a thermal characteristic measured by DSC, a peak is not present in a range from 50° C. to 400° C., other than a peak resulting from vaporization of adsorbed water.

(C) In a thermal characteristic measured by DSC, a peak is not present in a range from 50° C. to 270° C., other than a peak resulting from vaporization of adsorbed water, and at least one peak is present in a range from 270° C. to 400° C.

Among Y-form titanyl phthalocyanine crystals having the aforementioned X-ray diffraction characteristic (main peak: 27.2°), Y-form titanyl phthalocyanine crystals having the thermal characteristic (B) are referred to below as "Y-form titanyl phthalocyanine (B)" and Y-form titanyl phthalocyanine crystals having the thermal characteristic (C) are referred to below as "Y-form titanyl phthalocyanine (C)."

The Y-form titanyl phthalocyanines (B) and (C) are thought to each have a high quantum yield for a wavelength region of 700 nm or greater and excellent charge generating ability.

The Y-form titanyl phthalocyanines (B) and (C) have excellent crystal stability, are resistant to crystal dislocation in an organic solvent, and are readily dispersible in a photosensitive layer. In particular, the Y-form titanyl phthalocyanine (C) has excellent dispersibility.

<CuKα Characteristic X-Ray Diffraction Spectrum>

The Y-form titanyl phthalocyanine crystals can be identified based on a CuKα characteristic X-ray diffraction spectrum (optical characteristic). The following explains one example of a method for measuring the CuKα characteristic X-ray diffraction spectrum.

A sample (Y-form titanyl phthalocyanine crystals) is loaded into a sample holder of an X-ray diffraction spectrometer (for example, RINT (registered Japanese trademark) 1100 produced by Rigaku Corporation) and an X-ray diffraction spectrum is measured using a Cu X-ray tube, a tube voltage of 40 kV, a tube current of 30 mA, and CuKα characteristic X-rays having a wavelength of 1.542 Å. The measurement range (2θ) is, for example, from 3° to 40° (start angle: 3°, stop angle: 40°) and the scanning rate is, for example, 10°/minute. A main peak in the obtained X-ray diffraction spectrum is determined and a Bragg angle of the main peak is read from the X-ray diffraction spectrum.

The Y-form titanyl phthalocyanine crystals exhibit a main peak at a Bragg angle (2θ±0.2°) of 27.2° in the CuKα characteristic X-ray diffraction spectrum. In contrast, α-form titanyl phthalocyanine crystals exhibit a peak at a Bragg angle (2θ±0.2°) of 28.6° in a CuKα characteristic X-ray diffraction spectrum. Furthermore, β-form titanyl phthalocyanine crystals exhibit a peak at a Bragg angle (2θ±0.2°) of 26.2° in a CuKα characteristic X-ray diffraction spectrum.

Figure 2:
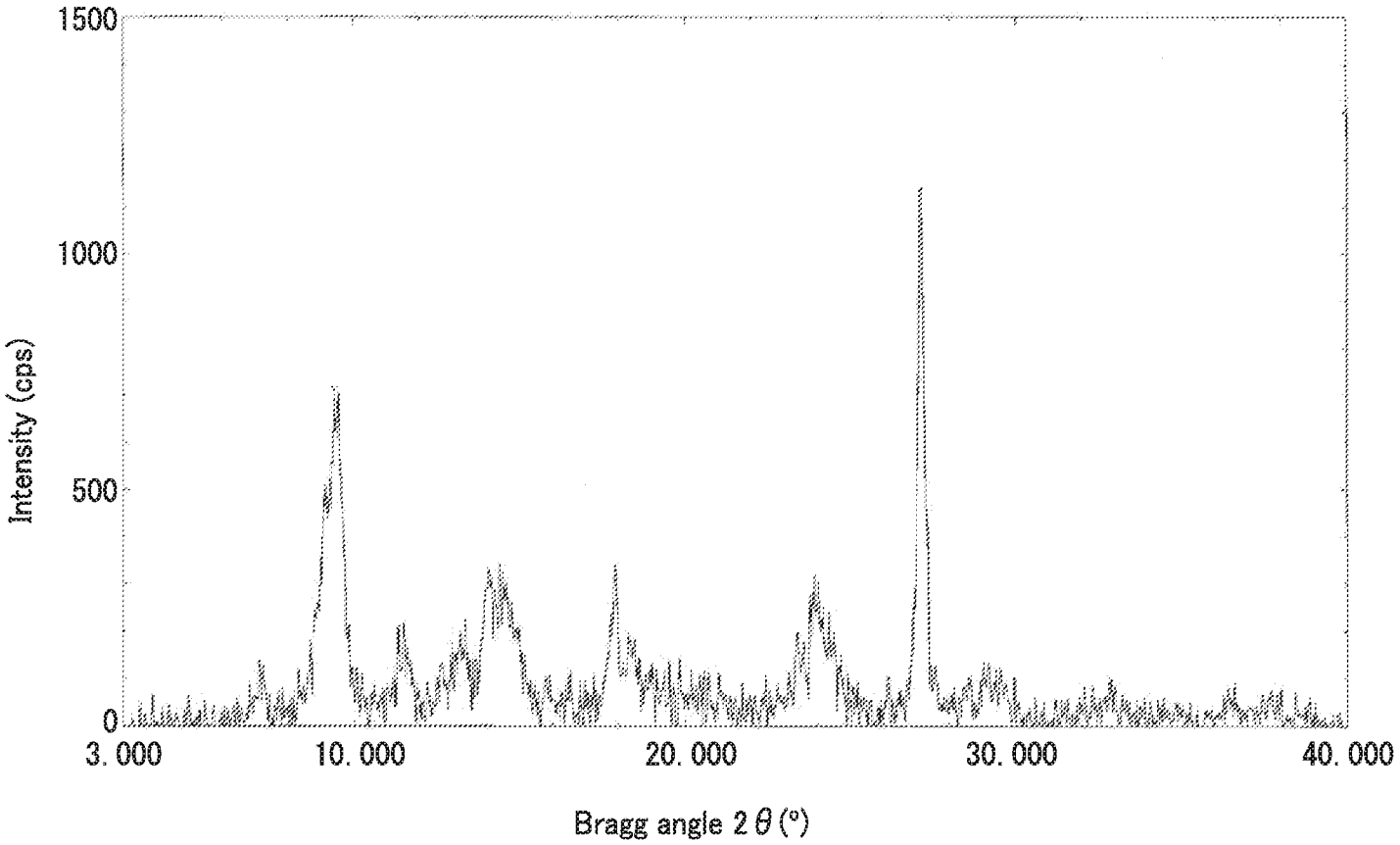
FIG. 2 is a CuKα characteristic X-ray diffraction spectral chart for one example of Y-form titanyl phthalocyanine crystals.
Figure 4:
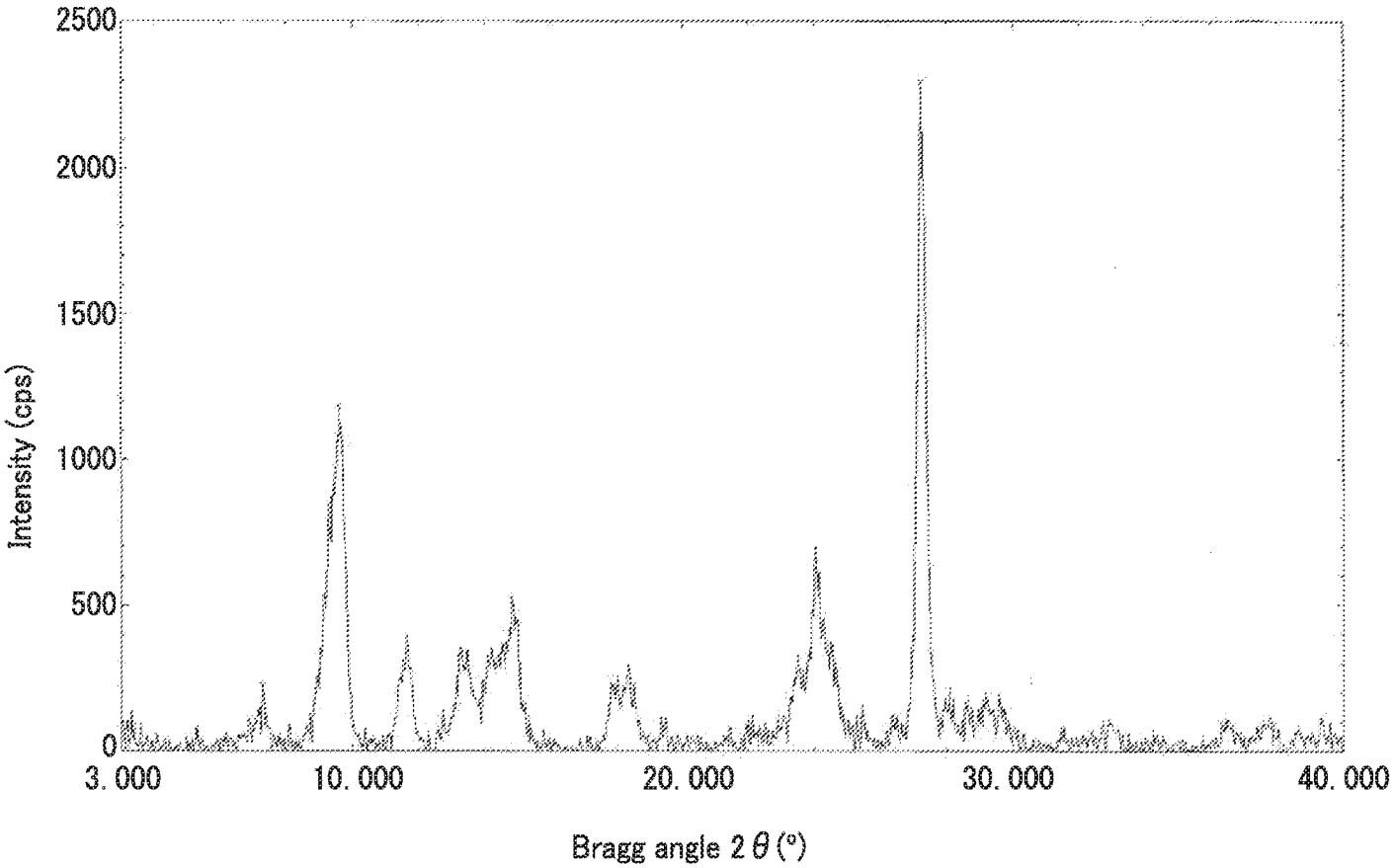
FIG. 4 is a CuKα characteristic X-ray diffraction spectral chart for another example of Y-form titanyl phthalocyanine crystals.

FIG. 2 is a CuKα characteristic X-ray diffraction spectral chart for one example of the Y-form titanyl phthalocyanine crystals used in the photosensitive member 1 according to the present embodiment. FIG. 4 is a CuKα characteristic X-ray diffraction spectral chart for another example of the titanyl phthalocyanine crystals used in the photosensitive member 1 according to the present embodiment. In FIGS. 2 and 4, the horizontal axis represents the Bragg angle (°) and the vertical axis represents intensity (cps). From the spectral charts in FIGS. 2 and 4, the measurement samples can be identified as Y-form titanyl phthalocyanine crystals.

<Differential Scanning Calorimetry Spectrum>

The crystal structure of the Y-form titanyl phthalocyanine can be identified based on a differential scanning calorimetry spectrum (thermal characteristic). The following explains one example of a method for measuring the differential scanning calorimetry spectrum.

An evaluation sample of a crystal powder is loaded into a sample pan and a differential scanning calorimetry spectrum is measured using a differential scanning calorimeter (for example, TAS-200 DSC8230D produced by Rigaku Corporation). The measurement range is, for example, from 40° C. to 400° C. and the heating rate is, for example, 20° C./minute.

The Y-form titanyl phthalocyanine (B) does not exhibit a peak in a range from 50° C. to 400° C. in the differential scanning calorimetry spectrum, other than a peak resulting from vaporization of adsorbed water.

The Y-form titanyl phthalocyanine (C) does not exhibit a peak in a range from 50° C. to 270° C., other than a peak resulting from vaporization of adsorbed water, and exhibits at least one peak in a range from 270° C. to 400° C. in the differential scanning calorimetry spectrum.

Figure 3:
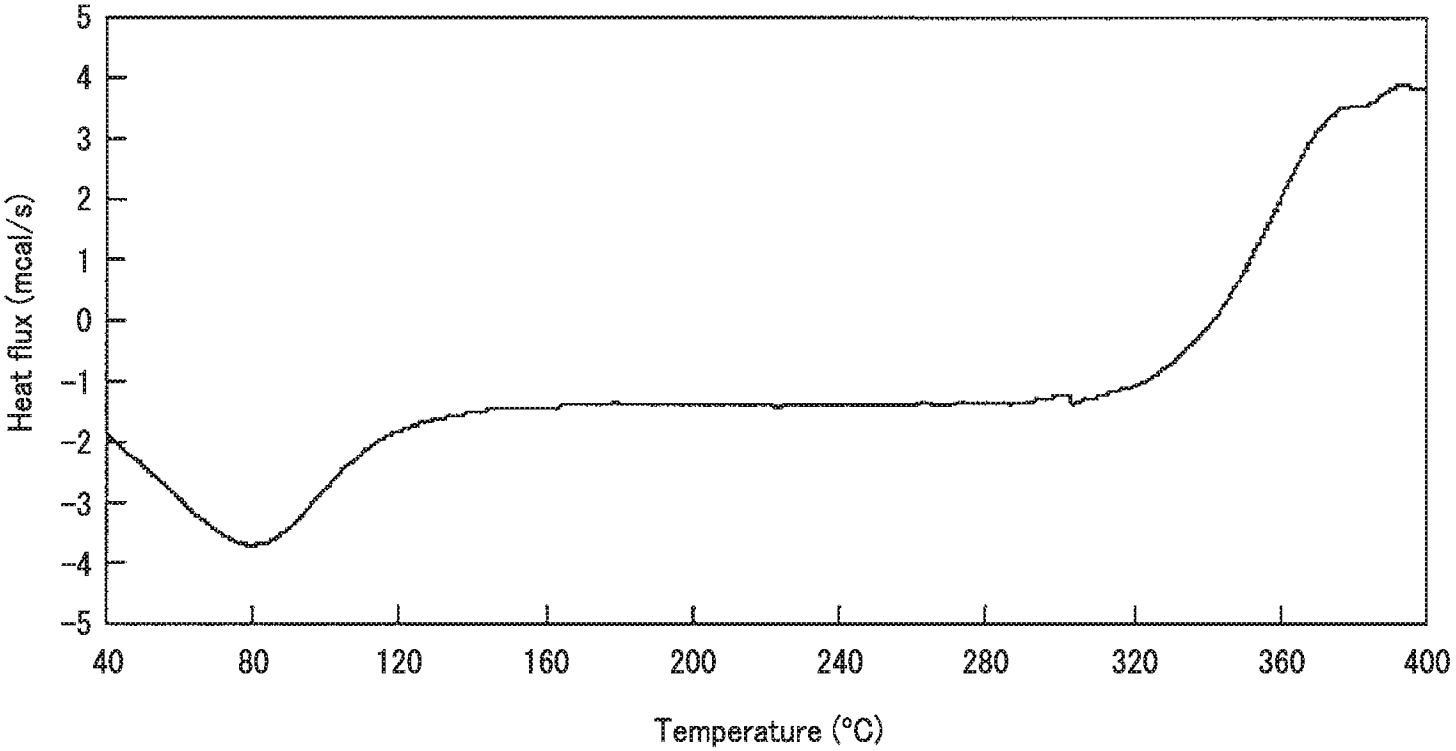
FIG. 3 is a differential scanning calorimetry spectral chart for the one example of Y-form titanyl phthalocyanine crystals.

FIG. 3 is a differential scanning calorimetry spectral chart for one example of the Y-form titanyl phthalocyanine crystals used in the photosensitive member 1 according to the present embodiment. More specifically, FIG. 3 is a differential scanning calorimetry spectral chart for the same titanyl phthalocyanine crystals as the CuKα characteristic X-ray diffraction spectral chart in FIG. 2. In FIG. 3, the horizontal axis represents temperature (° C.) and the vertical axis represents heat flux (mcal/s). In the spectral chart in FIG. 3, a peak is not observed in a range from 50° C. to 400° C., other than a peak resulting from vaporization of adsorbed water. Therefore, the measurement sample can be identified as the Y-form titanyl phthalocyanine (B).

Figure 5:
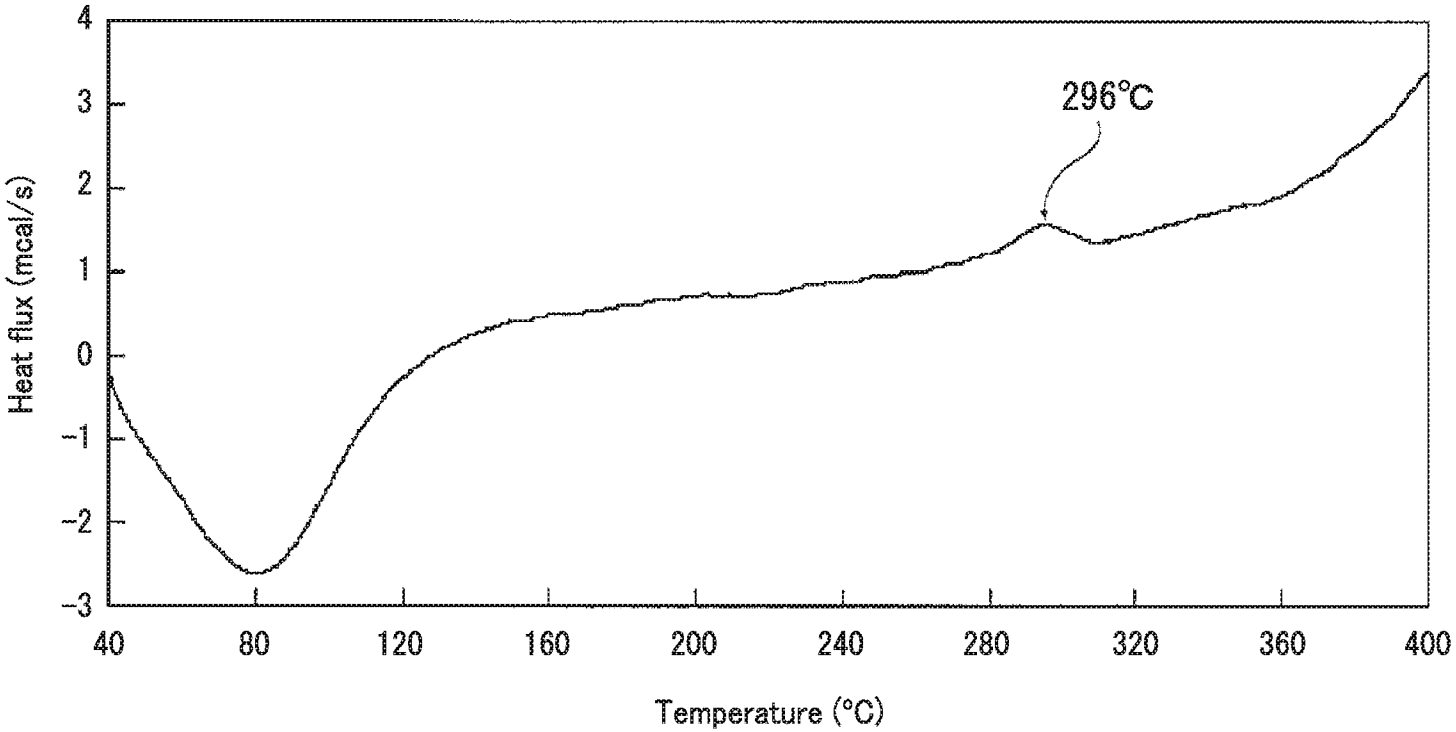
FIG. 5 is a differential scanning calorimetry spectral chart for the other example of Y-form titanyl phthalocyanine crystals.

FIG. 5 is a differential scanning calorimetry spectral chart for another example of the Y-form titanyl phthalocyanine crystals used in the photosensitive member 1 according to the present embodiment. More specifically, FIG. 5 is a differential scanning calorimetry spectral chart for the same titanyl phthalocyanine crystals as the CuKα characteristic X-ray diffraction spectral chart in FIG. 4. In FIG. 5, the horizontal axis represents temperature (° C.) and the vertical axis represents heat flux (mcal/s). In the spectral chart in FIG. 5, a peak is not observed in a range from 50° C. to 270° C., other than a peak resulting from vaporization of adsorbed water, and a peak is observed at 296° C. (i.e., in a range from 270° C. to 400° C.). Therefore, the measured titanyl phthalocyanine crystals can be identified as the Y-form titanyl phthalocyanine (C).

<Synthetic Method of Y-Form Titanyl Phthalocyanine Crystals>

The following explains a method for synthesizing the Y-form titanyl phthalocyanine crystals. The following is one example of a method for synthesizing the Y-form titanyl phthalocyanine (B).

First, a titanyl phthalocyanine compound is synthesized through a reaction represented by reaction formula (R-1) shown below (also referred to below as reaction (R-1)) or a reaction represented by reaction formula (R-2) shown below (also referred to below as reaction (R-2)). In reactions (R-1) and (R-2), Y represents a halogen atom, an alkyl group, an alkoxy group, a cyano group, or a nitro group, e represents an integer of at least 0 and no greater than 4, and R represents an alkyl group.

(R-1)

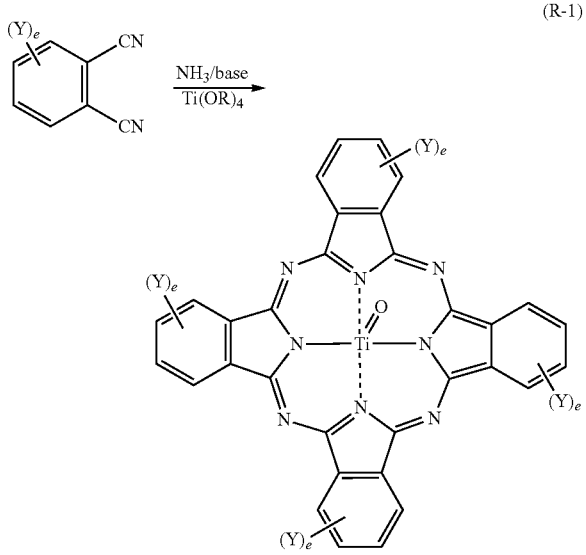

(R-2)

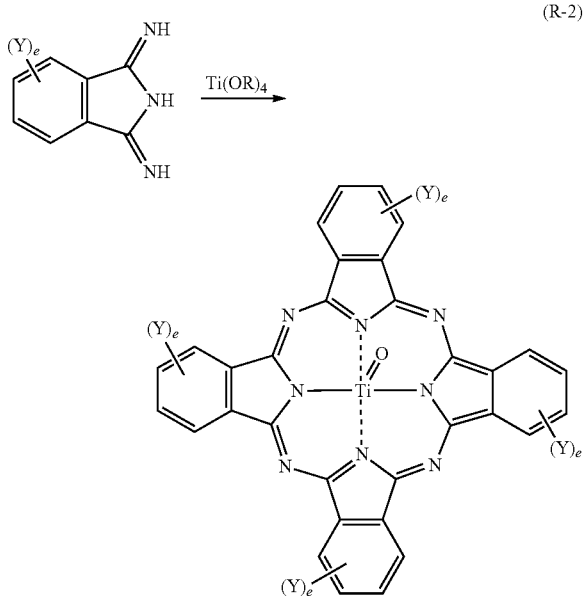

A titanyl phthalocyanine compound is synthesized in the reaction (R-1) through a reaction between a titanium alkoxide and phthalonitrile, or a derivative thereof. A titanyl phthalocyanine compound is synthesized in the reaction (R-2) through a reaction between a titanium alkoxide and 1,3-diiminoindoline, or a derivative thereof.

Next, pigmentation pretreatment is performed. More specifically, the titanyl phthalocyanine compound obtained through reaction (R-1) or reaction (R-2) is added to a water-soluble organic solvent and the resultant liquid mixture is stirred for a fixed time under heating. Thereafter, the resultant liquid mixture is left to stand for a fixed time at a lower temperature than during stirring to perform stabilization.

In the pigmentation pretreatment, one or more water-soluble organic solvents selected from the group consisting of alcohols (specific examples include methanol, ethanol, and isopropanol), N,N-dimethylformamide, N,N-dimethylacetamide, propionic acid, acetic acid, N-methylpyrrolidone, and ethylene glycol can be used. A small amount of water-insoluble organic solvent may be added to the water-soluble organic solvent. Stirring in the pigmentation pretreatment is preferably performed for at least 1 hour and no greater than 3 hours at a fixed temperature (for example, a specific selected temperature in a range from 70° C. to 200° C.). Stabilization after stirring is preferably performed for at least 5 hours and no greater than 10 hours at a fixed temperature. The temperature of the liquid mixture during stabilization is preferably at least 10° C. and no greater than 50° C., and more preferably at least 22° C. and no greater than 24° C.

Next, the water-soluble organic solvent is removed to yield crude crystals of the titanyl phthalocyanine compound. The crude crystals are subsequently dissolved in a solvent by a standard method and the resultant solution is then dripped into a poor solvent to cause recrystallization. Thereafter, the titanyl phthalocyanine compound is pigmented through filtration, water washing, milling treatment, filtration, and drying. As a result, the Y-form titanyl phthalocyanine (B) is obtained.

The poor solvent used for recrystallization can be one or more solvents selected from the group consisting of water, alcohols (specific examples include methanol, ethanol, and isopropanol), and water-soluble organic solvents (specific examples include acetone and dioxane).

The milling treatment is treatment in which a resultant solid after washing with water is dispersed in a non-aqueous solvent without being dried and while still containing water, and the resultant dispersion is subsequently stirred. The solvent used to dissolve the crude crystals can be one or more solvents selected from the group consisting of halogenated hydrocarbons (specific examples include dichloromethane, chloroform, ethyl bromide, and butyl bromide), trihaloacetic acids (specific examples include trifluoroacetic acid, trichloroacetic acid, and tribromoacetic acid), and sulfuric acid. The non-aqueous solvent used in the milling treatment can for example be a halogenated solvent such as chlorobenzene or dichloromethane.

The Y-form titanyl phthalocyanine (B) can also be synthesized according to the following method.

After the pigmentation pretreatment, the crude crystals of the titanyl phthalocyanine compound obtained after the water-soluble organic solvent is removed are treated by an acid paste method. More specifically, the crude crystals are dissolved in an acid and the resultant solution is dripped into water under ice cooling. Thereafter, the solution is stirred for a fixed time at a temperature of at least 22° C. and no greater than 24° C. and the titanyl phthalocyanine compound is caused to recrystallize in the liquid to yield a low-crystallinity titanyl phthalocyanine compound. Preferable examples of the acid used in the acid paste method include concentrated sulfuric acid and sulfonic acid.

Next, the low-crystallinity titanyl phthalocyanine compound is filtered and the resultant solid is washed with water. Thereafter, the milling treatment described above is performed. After the milling treatment, filtration and drying of the resultant solid are performed to yield the Y-form titanyl phthalocyanine (B).

The amount of the charge generating material in the photosensitive member 1 is preferably at least 0.1 parts by mass and no greater than 50 parts by mass relative to 100 parts by mass of the binder resin, and more preferably at least 0.5 parts by mass and no greater than 30 parts by mass.

[2-2. Hole Transport Material]

The hole transport material (1) is represented by general formula (1) shown below.

(1)

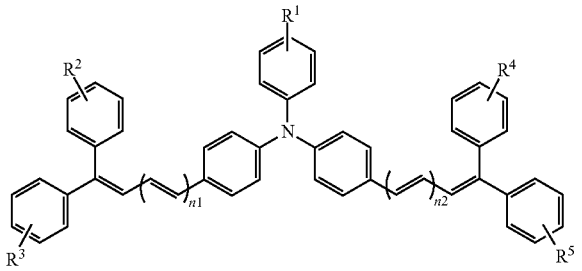

In general formula (1), $R^1$, $R^2$, $R^3$, $R^4$, and $R^5$ each represent, independently of one another, an optionally substituted alkyl group, an optionally substituted alkoxy group, an optionally substituted aryl group, an optionally substituted aryloxy group, an optionally substituted aralkyl group, a halogen atom, or a hydrogen atom. Also, n1 and n2 each represent, independently of one another, an integer of at least 0 and no greater than 4.

An alkyl group represented by any of $R^1$, $R^2$, $R^3$, $R^4$, and $R^5$ in general formula (1) is preferably an alkyl group having a carbon number of at least 1 and no greater than 20, more preferably an alkyl group having a carbon number of at least 1 and no greater than 12, particularly preferably an alkyl group having a carbon number of at least 1 and no greater than 6, and most preferably an alkyl group having a carbon number of at least 1 and no greater than 4. The alkyl group may be a straight-chain alkyl group or a branched alkyl group. Specific examples of preferable alkyl groups include a methyl group, an ethyl group, an n-propyl group, an isopropyl group, an n-butyl group, an isobutyl group, a sec-butyl group, a tert-butyl group, an n-pentyl group, an n-hexyl group, an n-heptyl group, an n-octyl group, an n-nonyl group, and an n-decyl group. Among the alkyl group listed above, a methyl group, an ethyl group, or an n-butyl group is preferable.

An alkoxy group represented by any of $R^1$, $R^2$, $R^3$, $R^4$, and $R^5$ in general formula (1) is preferably an alkoxy group having a carbon number of at least 1 and no greater than 20, more preferably an alkoxy group having a carbon number of at least 1 and no greater than 12, particularly preferably an alkoxy group having a carbon number of at least 1 and no greater than 6, and most preferably an alkoxy group having a carbon number of at least 1 and no greater than 4. The alkoxy group may be a straight-chain alkoxy group or a branched alkoxy group. Specific examples of preferable alkoxy groups include a methoxy group, an ethoxy group, an n-propoxy group, an isopropoxy group, an n-butoxy group, an isobutoxy group, a sec-butoxy group, a tert-butoxy group, an n-pentyloxy group, an n-hexyloxy group, an n-heptyloxy group, an n-octyloxy group, an n-nonyloxy group, and an n-decyloxy group. Among the alkoxy groups listed above, a methoxy group is preferable.

An aryl group represented by any of $R^1$, $R^2$. $R^3$, $R^4$, and $R^5$ in general formula (1) is for example an aryl group having a carbon number of at least 6 and no greater than 14 (specific examples include monocyclic rings and fused rings). Examples of possible monocyclic ring aryl groups include a phenyl group. Examples of possible fused ring aryl groups include bicyclic ring aryl groups (specific examples include a naphthyl group) and tricyclic ring aryl groups (specific examples include an anthryl group and a phenanthryl group).

An aryloxy group represented by any of $R^1$, $R^2$, $R^3$, $R^4$, and $R^5$ in general formula (1) is for example an aryloxy group having a carbon number of at least 6 and no greater than 14 (specific examples include monocyclic rings and fused rings). Examples of possible monocyclic ring aryloxy groups include a phenoxy group. Examples of possible fused ring aryloxy groups include bicyclic ring aryloxy groups (specific examples include a naphthyloxy group) and tricyclic ring aryloxy groups (specific examples include an anthryloxy group and a phenanthryloxy group).

An aralkyl group represented by any of $R^1$, $R^2$, $R^3$, $R^4$, and $R^5$ in general formula (1) is for example an aralkyl group having a carbon number of at least 7 and no greater than 20, and is preferably an aralkyl group having a carbon number of at least 7 and no greater than 12. Specific examples of preferable aralkyl groups include a benzyl group, a phenethyl group, an α-naphthylmethyl group, and a β-naphthylmethyl group.

A halogen atom represented by any of $R^1$, $R^2$. $R^3$, $R^4$, and $R^5$ in general formula (1) is for example a fluorine atom, a chlorine atom, a bromine atom, or an iodine atom.

An alkyl group or alkoxy group represented by any of $R^1$, $R^2$, $R^3$, $R^4$, and $R^5$ in general formula (1) may optionally have a substituent. Examples of possible substituents include halogen atoms (specific examples include a fluorine atom, a chlorine atom, a bromine atom, and an iodine atom), a nitro group, a cyano group, an amino group, a hydroxyl group, a carboxyl group, a sulfanyl group, a carbamoyl group, alkoxy groups having a carbon number of at least 1 and no greater than 12, cycloalkyl groups having a carbon number of at least 3 and no greater than 12, alkylsulfanyl groups having a carbon number of at least 1 and no greater than 12, alkylsulfonyl groups having a carbon number of at least 1 and no greater than 12, alkanoyl groups having a carbon number of at least 1 and no greater than 12, alkoxycarbonyl groups having a carbon number of at least 1 and no greater than 12, aryl groups having a carbon number of at least 6 and no greater than 14 (specific examples include monocyclic rings, bicyclic fused rings, and tricyclic fused rings), and heterocyclic groups having at least 6 members and no greater than 14 members (specific examples include monocyclic rings, bicyclic fused rings, and tricyclic fused rings). In a configuration in which the alkyl group or alkoxy group has a plurality of substituents, the substituents may be the same as or different from one another. No specific limitations are placed on the substitution positions of substituents.

An aryl group, aryloxy group, or aralkyl group represented by any of $R^1$, $R^2$, $R^3$, $R^4$, and $R^5$ in general formula (1) may optionally have a substituent. Examples of possible substituents include halogen atoms (specific examples include a fluorine atom, a chlorine atom, a bromine atom, and an iodine atom), a nitro group, a cyano group, an amino group, a hydroxyl group, a carboxyl group, a sulfanyl group, a carbamoyl group, alkyl groups having a carbon number of at least 1 and no greater than 12, alkoxy groups having a carbon number of at least 1 and no greater than 12, alkenyl groups having a carbon number of at least 2 and no greater than 12, aralkyl groups having a carbon number of at least 7 and no greater than 20, cycloalkyl groups having a carbon number of at least 3 and no greater than 12, alkylsulfanyl groups having a carbon number of at least 1 and no greater than 12, alkylsulfonyl groups having a carbon number of at least 1 and no greater than 12, alkanoyl groups having a carbon number of at least 1 and no greater than 12, alkoxycarbonyl groups having a carbon number of at least 1 and no greater than 12, aryl groups having a carbon number of at least 6 and no greater than 14 (specific examples include monocyclic rings, bicyclic fused rings, and tricyclic fused rings), and heterocyclic groups having at least 6 members and no greater than 14 members (specific examples include monocyclic rings, bicyclic fused rings, and tricyclic fused rings). In a configuration in which the aryl group, aryloxy group, or aralkyl group has a plurality of substituents, the substituents may be the same as or different from one another. No specific limitations are placed on substitutions positions of substituents.

In terms of charge stability of the photosensitive layer 3, $R^1$, $R^2$, $R^3$, $R^4$, and $R^5$ preferably each represent, independently of one another, an alkyl group having a carbon number of at least 1 and no greater than 6, an alkoxy group having a carbon number of at least 1 and no greater than 6, or a hydrogen atom.

Also, n1 and n2 each represent, independently of one another, an integer of at least 0 and no greater than 4. In terms of charge stability of the photosensitive layer 3, n1 and n2 preferably each represent, independently of one another, an integer of at least 0 and no greater than 2, and more preferably each represent 0 or 1.

Examples of the hole transport material (1) include hole transport materials (HT-1), (HT-3), (HT-5), (HT-6), (HT-11), (HT-16)-(HT-18), (HT-22), (HT-23), (HT-30), (HT-31), (HT-35), (HT-40), (HT-47), (HT-54), and (HT-56) shown further below in Table 1 of the Examples.

The meaning of symbols used in Tables 1 and 2 is as follows.

p-: Para
m-: Meta
Ph-: Phenyl
$CH_3$—: Methyl
$C_2H_5$—: Ethyl
di($CH_3$)—: Dimethyl
$(CH_3)_2CH$—: Isopropyl
$C_4H_9$—: n-Butyl
$CH_3O$—: Methoxy The photosensitive layer 3 may contain another hole transport material in addition to the hole transport material (1) so long as inclusion of the other hole transport material does not have adverse effects. The other hole transport material can be selected as appropriate from among known hole transport materials. In a configuration in which a hole transport material having film formation properties (for example, polyvinyl carbazole) is used as the other hole transport material, the other hole transport material also performs the same function as the binder resin. Therefore, the amount of the binder resin can be reduced compared to a configuration in which a hole transport material having film formation properties is not used.

The total amount of hole transport material in the photosensitive member 1 is preferably at least 10 parts by mass and no greater than 200 parts by mass relative to 100 parts by mass of the binder resin, and more preferably at least 10 parts by mass and no greater than 100 parts by mass.

[2-3. Electron Transport Material]

The photosensitive layer 3 contains an electron transport material. Through inclusion of the electron transport material, the photosensitive layer 3 can transport electrons and can be imparted with bipolar properties more easily.

Examples of electron transport materials that can be used include quinone-based compounds, diimide-based compounds (for example, naphthalenetetracarboxylic acid diimide derivative), hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroanthracene, dinitroacridine, succinic anhydride, maleic anhydride, and dibromomaleic anhydride. Examples of quinone-based compounds that can be used include naphthoquinone-based compounds, diphenoquinone-based compounds, anthraquinone-based compounds, azoquinone-based compounds, nitroanthraquinone-based compounds, and dinitroanthraquinone-based compounds.

Specific examples of quinone-based compounds that can be used include compounds represented by chemical formulae (ET-1)-(ET-4) (also referred to below as electron transport materials (ET-1)-(ET-4)).

(ET-1)

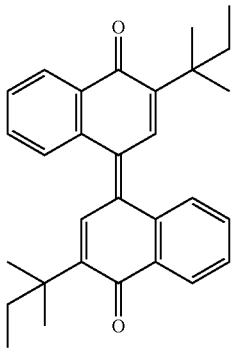

(ET-2)

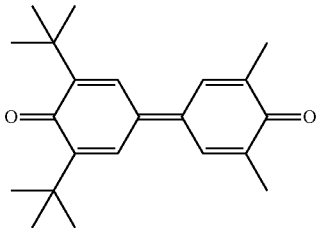

(ET-3)

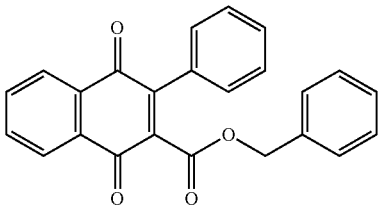

-continued (ET-4)

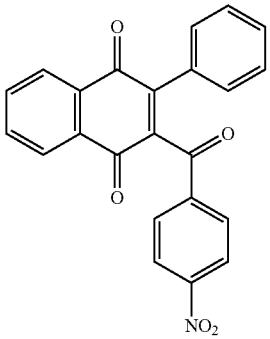

Specific examples of diimide-based compounds that can be used include a compound represented by chemical formula (ET-5) (also referred to below as electron transport material (ET-5)).

(ET-5)

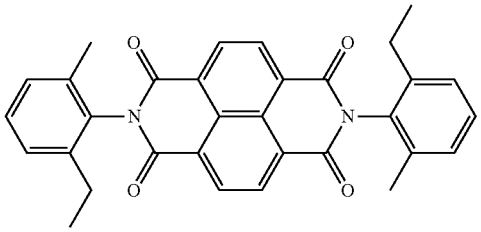

Specific examples of hydrazone-based compounds that can be used include a compound represented by chemical formula (ET-6) (also referred to below as electron transport material (ET-6)).

(ET-6)

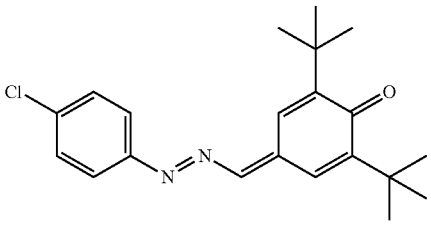

Any one of the electron transport materials listed above may be used or a combination of any two or more of the electron transport materials listed above may be used.

The amount of the electron transport material in the photosensitive member 1 is preferably at least 5 parts by mass and no greater than 100 parts by mass relative to 100 parts by mass of the binder resin, and more preferably at least 10 parts by mass and no greater than 80 parts by mass.

[2-4. Binder Resin]

Examples of binder resins that can be used include thermoplastic resins, thermosetting resins, and photocurable resins. Examples of thermoplastic resins that can be used include polycarbonate resins, styrene-based resins, styrene-butadiene resins, styrene-acrylonitrile resins, styrene-maleic acid resins, styrene-acrylic acid-based resins, acrylic copolymers, polyethylene resins, ethylene-vinyl acetate resins, chlorinated polyethylene resins, polyvinyl chloride resins, polypropylene resins, ionomers, vinyl chloride-vinyl acetate resins, alkyd resins, polyamide resins, polyurethanes, polyarylate resins, polysulfone resins, diallyl phthalate resins, ketone resins, polyvinyl butyral resins, polyether resins, and polyester resins. Examples of thermosetting resins that can be used include silicone resins, epoxy resins, phenolic resins, urea resins, melamine resins, and other crosslinkable thermosetting resins. Examples of photocurable resins that can be used include epoxy-acrylic acid-based resins and urethane-acrylic acid-based resins.

Among the resins listed above, polycarbonate resins are favorable in terms of providing a photosensitive layer 3 that has an excellent balance of workability, mechanical characteristics, optical characteristics, and/or abrasion resistance. Examples of polycarbonate resins that can be used include bisphenol Z polycarbonate resins, bisphenol B polycarbonate resins, bisphenol CZ polycarbonate resins, bisphenol C polycarbonate resins, and bisphenol A polycarbonate resins. Specific examples of polycarbonate resins that can be used include a resin having a repeating unit represented by chemical formula (Resin-1).

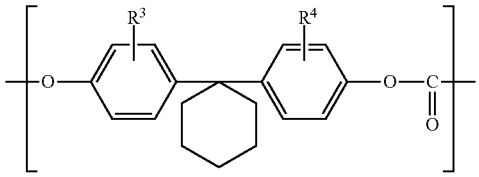

(Resin-1)

In chemical formula (Resin-1), $R^3$ and $R^4$ each represent, independently of one another, a hydrogen atom or an optionally substituted alkyl group having a carbon number of at least 1 and no greater than 3, with a hydrogen atom being preferable.

Examples of alkyl groups having a carbon number of at least 1 and no greater than 3 that may be represented by $R^3$ and $R^4$ include a methyl group, an ethyl group, an n-propyl group, and an isopropyl group, with a methyl group being preferable.

An alkyl group having a carbon number of at least 1 and no greater 3 that is represented by either of $R^3$ or $R^4$ may optionally have a substituent. Examples of possible substituents include halogen atoms (specific examples include a fluorine atom, a chlorine atom, a bromine atom, and an iodine atom), a nitro group, a cyano group, an amino group, a hydroxyl group, a carboxyl group, a sulfanyl group, a carbamoyl group, alkoxy groups having a carbon number of at least 1 and no greater than 12, cycloalkyl groups having a carbon number of at least 3 and no greater than 12, alkylsulfanyl groups having a carbon number of at least 1 and no greater than 12, alkylsulfonyl groups having a carbon number of at least 1 and no greater than 12, alkanoyl groups having a carbon number of at least 1 and no greater than 12, alkoxycarbonyl groups having a carbon number of at least 1 and no greater than 12, and aryl groups having a carbon number of at least 6 and no greater than 14.

Any one of the binder resins listed above may be used or a combination of any two or more of the binder resins listed above may be used.

The binder resin preferably has a viscosity average molecular weight of at least 20,0000, and more preferably at least 20,000 and no greater than 65,000. As a result of the viscosity average molecular weight of the binder resin being at least 20,000, a dense photosensitive layer 3 can be formed more readily, and gas resistance and a repeated use characteristic of the photosensitive member 1 can be improved more easily. Furthermore, as a result of the viscosity average molecular weight of the binder resin being at least 20,000, abrasion resistance of the binder resin can be made sufficiently high and the photosensitive layer 3 is abraded less readily. As a result of the viscosity average molecular weight of the binder resin being no greater than 65,000, the binder resin dissolves more readily in a solvent in formation of the photosensitive layer 3 and viscosity of an application liquid for photosensitive layer formation is not excessively high. Consequently, the photosensitive layer 3 tends to be formed more easily.

[2-5. Additives]

In the photosensitive member 1 of the present embodiment, one or more of the photosensitive layer 3, the intermediate layer 4, and the protective layer 5 may contain various types of additives so long as electrophotographic characteristics of the photosensitive member 1 are not adversely affected. Examples of additives that can be used include antidegradants (specifically examples include antioxidants, radical scavengers, quenchers, and ultraviolet absorbing agents), softeners, surface modifiers, extenders, thickeners, dispersion stabilizers, waxes, acceptors, donors, surfactants, plasticizers, sensitizers, and leveling agents. Examples of antioxidants that can be used include BHT (di(tert-butyl)p-cresol), hindered phenols, hindered amines, paraphenylenediamines, arylalkanes, hydroquinone, spirochromanes, spiroindanones, derivatives of any of the above compounds, organosulfur compounds, and organophosphorous compounds.

[3. Intermediate Layer]

The photosensitive member 1 according to the present embodiment may optionally include an intermediate layer 4 (for example, an underlayer). The intermediate layer 4 is located between the conductive substrate 2 and the photosensitive layer 3 in the photosensitive member 1. The intermediate layer 4 for example contains inorganic particles and a resin for use in the intermediate layer 4 (intermediate layer resin). Provision of the intermediate layer 4 can facilitate flow of current generated when the photosensitive member 1 is exposed to light and inhibit increasing resistance, while also maintaining insulation to a sufficient degree so as to inhibit occurrence of leakage current.

Examples of inorganic particles that can be used include particles of metals (specific examples include aluminum, iron, and copper), metal oxides (specific examples include titanium oxide, alumina, zirconium oxide, tin oxide, and zinc oxide), and non-metal oxides (specific examples include silica). Any one of the types of inorganic particles listed above may be used or a combination of any two or more of the types of organic particles listed above may be used.

No specific limitations are placed on the intermediate layer resin other than being a resin that can be used to form the intermediate layer 4.

Through the above, the photosensitive member 1 of the present embodiment has been explained with reference to FIG. 1. According to the photosensitive member of the present embodiment, it is possible to inhibit a reduction in charge potential of the surface of the photosensitive member from occurring even when the photosensitive member is used while exposed to a gas of an oxidizing substance or a nitrogen oxide and even when the photosensitive member is repeatedly used. Therefore, the photosensitive member of the present embodiment is highly suitable for use as an image bearing member in various image forming apparatuses.

Second Embodiment: Electrophotographic Photosensitive Member Manufacturing Method A second embodiment relates to a method for manufacturing a photosensitive member. The following explains a method for manufacturing a photosensitive member according to the present embodiment with reference to FIG. 1. The method for manufacturing a photosensitive member 1 according to the present embodiment includes forming a photosensitive layer. In formation of the photosensitive layer, an application liquid (application liquid for photosensitive layer formation) is applied onto a conductive substrate 2 and at least a portion of a solvent included in the applied application liquid for photosensitive layer formation is removed to form a photosensitive layer. The solvent for example includes at least one of tetrahydrofuran and toluene. The application liquid for photosensitive layer formation includes at least Y-form titanyl phthalocyanine crystals, the hole transport material (1), an electron transport material, a binder resin, and the solvent. The application liquid for photosensitive layer formation can be prepared by dissolving or dispersing the Y-form titanyl phthalocyanine crystals (charge generating material), the hole transport material (1), the electron transport material, and the binder resin in the solvent. Various additives may optionally be added to the application liquid for photosensitive layer formation as necessary.

The solvent in the application liquid for photosensitive layer formation includes at least one of tetrahydrofuran and toluene. Use of a solvent such as described above tends to improve solubility and/or dispersibility of the charge generating material, the electron transport material, the hole transport material (1), and the binder resin in the application liquid for photosensitive layer formation. As a result, it is easier to form a homogenous photosensitive layer 3 and it is easier to improve charge potential stability of the surface of the photosensitive member 1.

The application liquid for photosensitive layer formation may include another solvent in addition to at least one of tetrahydrofuran and toluene. Examples of other solvents that can be used include alcohols (for example, methanol, ethanol, isopropanol, or butanol), aliphatic hydrocarbons (for example, n-hexane, octane, or cyclohexane), aromatic hydrocarbons (for example, benzene, toluene, or xylene), halogenated hydrocarbons (for example, dichloromethane, dichloroethane, carbon tetrachloride, or chlorobenzene), ethers (for example, dimethyl ether, diethyl ether, tetrahydrofuran, ethylene glycol dimethyl ether, or diethylene glycol dimethyl ether), ketones (for example, acetone, methyl ethyl ketone, or cyclohexanone), esters (for example, ethyl acetate or methyl acetate), dimethyl formaldehyde, N,N-dimethylformamide (DMF), and dimethyl sulfoxide. The application liquid for photosensitive layer formation preferably includes at least one of tetrahydrofuran and toluene. Any one of the solvents listed above may be used or a combination of any two or more of the solvents listed above may be used. Among the solvents listed above, use of a non-halogenated solvent is preferable.

The application liquid for photosensitive layer formation is prepared by mixing the components to disperse the components in the solvent. Mixing or dispersion can for example be performed using a bead mill, a roll mill, a ball mill, an attritor, a paint shaker, or an ultrasonic disperser.

The application liquid for photosensitive layer formation may include a surfactant or a leveling agent in order to improve dispersibility of the components or improve surface flatness of the formed layers.

No specific limitations are placed on the method by which the application liquid for photosensitive layer formation is applied other than being a method that enables uniform application of the application liquid for photosensitive layer formation. Examples of application methods that can be used include dip coating, spray coating, spin coating, and bar coating.

No specific limitations are placed on the method by which at least a portion of the solvent in the application liquid for photosensitive layer formation is removed other than being a method that enables evaporation of the solvent in the application liquid for photosensitive layer formation. Examples of methods that can be used to remove the solvent include heating, pressure reduction, and a combination of heating and pressure reduction. One specific example of a method involves heat treatment (hot-air drying) using a high-temperature dryer or a reduced pressure dryer. The heat treatment is for example performed for at least 3 minutes and no greater than 120 minutes at a temperature of at least 40° C. and no greater than 150° C. A portion of the solvent in the application liquid for photosensitive layer formation may be removed in photosensitive layer formation. The photosensitive layer 3 may contain the solvent included in the application liquid for photosensitive layer formation (for example, at least one of tetrahydrofuran and toluene) after photosensitive layer formation has been carried out. Preferably, the amount of at least one of tetrahydrofuran and toluene in the photosensitive layer (the total amount of tetrahydrofuran and toluene in a situation in which the photosensitive layer contains both) is small (for example, a few ppm). The amount of at least one of tetrahydrofuran and toluene contained in the photosensitive layer can for example be determined using a gas chromatograph mass spectrometer.

The manufacturing method of the present embodiment may include either or both of formation of an intermediate layer 4 and formation of a protective layer 5 as necessary. Formation of the intermediate layer 4 and formation of the protective layer 5 can be carried out by a method selected appropriately from known methods.

Through the above, a method for manufacturing the photosensitive member according to the present embodiment has been described with reference to FIG. 1. According to the manufacturing method of the present embodiment, a homogenous photosensitive layer can be formed more easily and reduction in charge potential of the surface of the photosensitive member can be inhibited more easily.

Third Embodiment: Image Forming Apparatus

Figure 6:
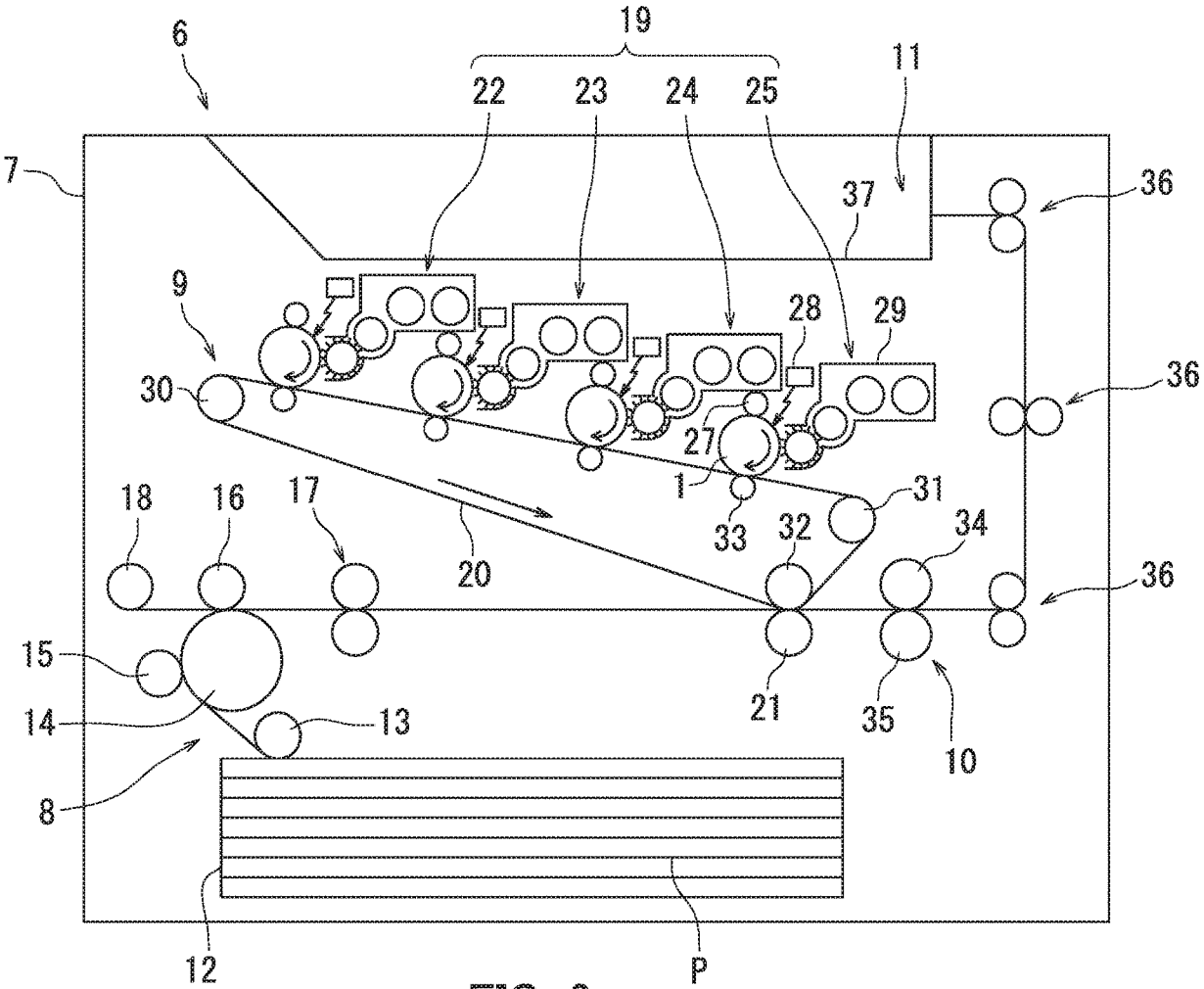
FIG. 6 is a schematic diagram illustrating configuration of an image forming apparatus according to a third embodiment.

A third embodiment relates to an image forming apparatus. The following explains an image forming apparatus according to the present embodiment with reference to FIG. 6. FIG. 6 is a schematic diagram illustrating configuration of an image forming apparatus 6 according to the third embodiment. The image forming apparatus 6 includes the photosensitive member 1 according to the first embodiment.

The image forming apparatus 6 according to the present embodiment includes an image bearing member (equivalent to a photosensitive member) 1, a charging section (equivalent to a charging device) 27, a light exposure section (equivalent to a light exposure device) 28, a developing section (equivalent to a developing device) 29, and a transfer section. The charging section 27 has a positive charging polarity and positively charges the surface of the image bearing member 1. The light exposure section 28 forms an electrostatic latent image on the surface of the image bearing member 1 by exposing the charged surface of the image bearing member 1 to light. The developing section 29 develops the electrostatic latent image into a toner image. The transfer section transfers the toner image from the image bearing member 1 to a transfer target (equivalent to an intermediate transfer belt) 20.

No specific limitations are placed on the image forming apparatus 6 other than being an electrophotographic image forming apparatus. The image forming apparatus 6 may for example be a monochrome image forming apparatus or a color image forming apparatus. The image forming apparatus 6 of the present embodiment may be a tandem color image forming apparatus such that toners of different colors are used to form toner images of the different colors.

The following explains the image forming apparatus 6 using a tandem color image forming apparatus as an example. The image forming apparatus 6 includes a plurality of photosensitive members 1 and a plurality of developing sections 29 that are arranged in a specific direction. Each of the developing sections 29 is located opposite to a corresponding one of the photosensitive members 1. Each of the developing sections 29 conveys a toner by bearing the toner on the surface thereof. Each of the developing sections 29 includes a development roller. The development roller supplies the conveyed toner onto the surface of the corresponding image bearing member 1.

As illustrated in FIG. 6, the image forming apparatus 6 includes a box-type apparatus housing 7. A paper feed section 8, an image forming section 9, and a fixing section 10 are located inside the apparatus housing 7. The paper feed section 8 feeds paper P. The image forming section 9 transfers a toner image based on image data onto the paper P fed by the paper feed section 8 while conveying the paper P. The fixing section 10 fixes, to the paper P, the unfixed toner image that is transferred onto the paper P by the image forming section 9. A paper ejection section 11 is located on an upper surface of the apparatus housing 7. The paper ejection section 11 ejects the paper P after the paper P has been subjected to a fixing process by the fixing section 10.

The paper feed section 8 includes a paper feed cassette 12, a first pickup roller 13, paper feed rollers 14, 15, and 16, and a pair of registration rollers 17. The paper feed cassette 12 is insertable into and detachable from the apparatus housing 7. The paper feed cassette 12 can store paper P of various sizes. The first pickup roller 13 is located above a left side of the paper feed cassette 12. The first pickup roller 13 picks up paper P stored in the paper feed cassette 12 one sheet at a time. The paper feed rollers 14, 15, and 16 convey the paper P picked up by the first pickup roller 13. The pair of registration rollers 17 temporarily halts the paper P conveyed by the paper feed rollers 14, 15, and 16 and subsequently supplies the paper P to the image forming section 9 at a specific timing.

The paper feed section 8 also includes a manual feed tray (not illustrated) and a second pickup roller 18. The manual feed tray is attached to a left side surface of the apparatus housing 7. The second pickup roller 18 picks up paper P loaded on the manual feed tray. The paper P picked up by the second pickup roller 18 is conveyed by the paper feed rollers 14, 15, and 16 and is supplied to the image forming section 9 at the specific timing by the pair of registration rollers 17.

The image forming section 9 includes an image forming unit 19, an intermediate transfer belt 20, and a secondary transfer roller 21. The image forming unit 19 performs primary transfer of a toner image onto the surface of the intermediate transfer belt 20 (contact surface with primary transfer rollers 33). The toner image that undergoes primary transfer is formed based on image data transmitted from a higher-level device, such as a computer. The secondary transfer roller 21 performs secondary transfer of the toner image on the intermediate transfer belt 20 to the paper P fed from the paper feed cassette 12.

The image forming unit 19 includes a yellow toner supply unit 25, a magenta toner supply unit 24, a cyan toner supply unit 23, and a black toner supply unit 22 that are arranged in order from upstream (right side in FIG. 6) to downstream in a circulation direction of the intermediate transfer belt 20 relative to the yellow toner supply unit 25 as a reference point. A photosensitive member 1 is located at a central position in each of the units 22, 23, 24, and 25. The photosensitive member 1 is provided such as to be rotatable in an arrow direction (clockwise). Note that each of the units 22, 23, 24, and 25 may be a process cartridge described below that is attachable to and detachable from a main body of the image forming apparatus 6.

A charging section 27, a light exposure section 28, and a developing section 29 are located around each of the photosensitive members 1 in order from upstream in a rotation direction of the image bearing member 1 relative to the charging section 27 as a reference point. After transfer to the intermediate transfer belt 20 is complete for a given region of the photosensitive member 1, the region of the photosensitive member 1 is recharged by the charging section 27 without being subjected to static elimination or blade cleaning.

A static eliminator (not illustrated) and a cleaning device (not illustrated) may be provided upstream of the charging section 27 in the rotation direction of the image bearing member 1. The static eliminator eliminates static from a circumferential surface of the image bearing member 1 after primary transfer of the toner image onto the intermediate transfer belt 20 has been performed. After the circumferential surface of the image bearing member 1 has been subjected to cleaning and static elimination by the cleaning device and the static eliminator, the circumferential surface is subjected to a new charging process as the circumferential surface passes the charging section 27.

The image forming apparatus 6 of the present embodiment may be designed without a static eliminator (equivalent to a static eliminating section). In other words, the image forming apparatus 6 of the present embodiment may be an apparatus from which a static eliminator is omitted and which adopts a process without static elimination. An image forming apparatus that adopts a process without static elimination is normally more susceptible to a reduction in surface potential of a photosensitive member 1. However, as explained further above, in the case of the photosensitive member 1 of the present embodiment, charge potential of the surface of the image bearing member 1 tends to have excellent stability even when the surface is charged repeatedly. Therefore, it is thought that as a result of the image forming apparatus 6 of the present embodiment including the photosensitive member 1 described above in the first embodiment as the image bearing member 1, it is possible to inhibit a reduction in surface potential of the image bearing member 1 from occurring even in a configuration in which the image forming apparatus 6 does not include a static eliminator.

The image forming apparatus 6 according to the present embodiment can be designed without a cleaning device (equivalent to a cleaning section, for example, a blade cleaning section). In a configuration in which the image forming apparatus 6 according to the present embodiment includes a cleaning device and a static eliminator, a charging section 27, a light exposure section 28, a developing section 29, a cleaning device, and a static eliminator are provided around each of the photosensitive members 1 in order from upstream in the rotation direction of the photosensitive member 1.

The charging section 27 charges the surface of the image bearing member 1. More specifically, the charging section 27 uniformly charges the circumferential surface of the image bearing member 1 as the image bearing member 1 rotates in the arrow direction. No specific limitations are placed on the charging section 27 other than enabling uniform charging of the circumferential surface of the image bearing member 1. The charging section 27 may be a non-contact charging section or a contact charging section. Examples of the charging section 27 include a corona charging section, a charging roller, and a charging brush. The charging section 27 is preferably a contact charging section (more specifically, a charging roller or a charging brush), and is more preferably a charging roller. Discharge of active gases (for example, ozone and nitrogen oxides) generated by the charging section 27 can be inhibited by using a contact charging section 27. As a result, deterioration of the photosensitive layer 3 due to active gases can be inhibited while also achieving a design that takes into consideration use in an office environment.

In a configuration in which the charging section 27 includes a contact charging roller, the charging roller charges the circumferential surface (surface) of the image bearing member 1 while in contact with the image bearing member 1. The charging roller described above is for example a charging roller that passively rotates in accordance with rotation of the image bearing member 1 while in contact with the image bearing member 1. The charging roller is for example a charging roller for which at least a surface part thereof is made from a resin. In a more specific example, the charging roller is a charging roller that includes a metal core that is rotatably supported, a resin layer formed on the metal core, and a voltage applying section that applies voltage to the metal core. In a configuration in which the charging section 27 includes a charging roller such as described above, the charging section 27 can charge the surface of the photosensitive member 1, which is in contact therewith via the resin layer, through the voltage applying section applying voltage to the metal core.

No specific limitations are placed on the voltage applied by the charging section 27. However, a configuration in which the charging section 27 applies only a direct current voltage is more preferable than a configuration in which the charging section 27 applies an alternating current voltage or a configuration in which the charging section 27 applies a composite voltage of an alternating current voltage superimposed on a direct current voltage. The amount of abrasion of the photosensitive layer 3 tends to be smaller in a configuration in which the charging section 27 only applies a direct current voltage. As a result, suitable images can be formed. The charging section 27 preferably applies a direct current voltage of at least 1,000 V and no greater than 2,000 V to the photosensitive member 1, more preferably applies a direct current voltage of at least 1,200 V and no greater than 1,800 V, and particularly preferably applies a direct current voltage of at least 1,400 V and no greater than 1,600 V.

No specific limitations are placed on the resin used to make the resin layer of the charging roller other than enabling favorable charging of the circumferential surface of the photosensitive member 1. Specific examples of the resin used to make the resin layer include silicone resins, urethane resins, and silicone modified resins. The resin layer may contain an inorganic filler.

The light exposure section 28 is a so-called laser scanning unit. The light exposure section 28 forms an electrostatic latent image on the surface of the image bearing member 1 by exposing the surface of the image bearing member 1 to light while the surface of the image bearing member 1 is charged. More specifically, the light exposure section 28 emits laser light based on image data input from a higher-level device, such as a computer, onto the circumferential surface of the image bearing member 1, which is uniformly charged by the charging section 27. Through the above, an electrostatic latent image based on the image data is formed on the circumferential surface of the photosensitive member 1.

The developing section 29 develops the electrostatic latent image into a toner image. More specifically, the developing section 29 supplies toner onto the circumferential surface of the image bearing member 1 on which the electrostatic latent image is formed to form a toner image based on the image data. The toner image that is formed subsequently undergoes primary transfer onto the intermediate transfer belt 20.

The intermediate transfer belt 20 is an endless circulating belt. The intermediate transfer belt 20 is wrapped against a drive roller 30, a driven roller 31, a backup roller 32, and a plurality of primary transfer rollers 33. The intermediate transfer belt 20 is located such that the circumferential surface of each of the photosensitive members 1 is in contact with the surface (contact surface) of the intermediate transfer belt 20.

The intermediate transfer belt 20 is pressed against each of the photosensitive members 1 by the primary transfer roller 33 located opposite to the photosensitive member 1. The intermediate transfer belt 20 circulates endlessly while in a pressed state by the primary transfer rollers 33. The drive roller 30 is rotationally driven by a drive source, such as a stepping motor, and imparts driving force that causes endless circulation of the intermediate transfer belt 20. The driven roller 31, the backup roller 32, and the primary transfer rollers 33 are freely rotatable. The driven roller 31, the backup roller 32, and the primary transfer rollers 33 passively rotate in accompaniment to endless circulation of the intermediate transfer belt 20 by the drive roller 30. The driven roller 31, the backup roller 32, and the primary transfer rollers 33 support the intermediate transfer belt 20 while passively rotating, through the intermediate transfer belt 20, in accordance with active rotation of the drive roller 30.

The transfer section transfers a toner image onto the intermediate transfer belt 20 from each of the image bearing members. More specifically, each of the primary transfer rollers 33 applies a primary transfer bias (more specifically, a bias of opposite polarity to charging polarity of the toner) to the intermediate transfer belt 20. As a result, toner images on the respective photosensitive members 1 are transferred (primary transfer) in order onto the intermediate transfer belt 20, which is driven to circulate in an arrow direction (counterclockwise) by the drive roller 30. Each of the toner images is transferred onto the intermediate transfer belt 20 between the corresponding photosensitive member 1 and primary transfer roller 33.

The secondary transfer roller 21 applies a secondary transfer bias (more specifically, a bias of opposite polarity to the toner images) to paper P. As a result, the toner images that have undergone primary transfer onto the intermediate transfer belt 20 are transferred onto the paper P between the secondary transfer roller 21 and the backup roller 32. Through the above, an unfixed toner image is transferred onto the paper P.

The fixing section 10 fixes the unfixed toner image that is transferred onto the paper P by the image forming section 9. The fixing section 10 includes a heating roller 34 and a pressure roller 35. The heating roller 34 is heated by a conductive heating element. The pressure roller 35 is located opposite to the heating roller 34 and has a circumferential surface that is pressed against a circumferential surface of the heating roller 34.

A transfer image that is transferred onto paper P by the secondary transfer roller 21 in the image forming section 9 is fixed to the paper P through a fixing process in which the paper P is heated as the paper P passes between the heating roller 34 and the pressure roller 35. The paper P is ejected to the paper ejection section 11 after being subjected to the fixing process. Conveyance rollers 36 are provided at appropriate positions between the fixing section 10 and the paper ejection section 11.

The image forming apparatus 6 according to the present embodiment is preferably configured to have a process speed of at least 120 mm/s.

The reason for having the process speed specified above is that such a process speed enables high-speed image formation and improved image formation efficiency. In a configuration with a high process speed (at least 120 mm/s), photosensitive member deterioration typically occurs more readily due to gases such as ozone being produced. However, the photosensitive member 1 described above has excellent surface charge potential stability even in the presence of gases such as ozone. Therefore, it is thought that in a configuration in which the image forming apparatus 6 includes the photosensitive member 1 described above, deterioration of the photosensitive member 1 can be inhibited even when the image forming apparatus 6 has a process speed of at least 120 mm/s. As a result, high quality images with excellent resolution can be obtained.

From the point of view of increased speed, the process speed is more preferably at least 160 mm/s and particularly preferably at least 180 mm/s.

The paper ejection section 11 is formed by a recess at the top of the apparatus housing 7. An exit tray 37 that receives ejected paper P is provided on a bottom surface of the recess.

Through the above, the image forming apparatus 6 of the present embodiment has been explained with reference to FIG. 6. The image forming apparatus 6 includes the photosensitive member 1 described above in the first embodiment as an image bearing member. Inclusion of such a photosensitive member enables the image forming apparatus 6 to inhibit occurrence of image defects.

Fourth Embodiment: Process Cartridge

A fourth embodiment relates to a process cartridge. The process cartridge of the present embodiment includes the photosensitive member 1 of the first embodiment.

The process cartridge can for example have a unitized configuration including the photosensitive member of the first embodiment. The process cartridge may be designed to be freely attachable to and detachable from an image forming apparatus. The process cartridge can for example adopt a unitized configuration including, in addition to the photosensitive member, one or more selected from the group consisting of a charging section, a light exposure section, a developing section, a transfer section, a cleaning section, and a static eliminating section. In a situation in which the process cartridge is to be used in an image forming apparatus that adopts a process without either or both of static elimination and cleaning, either or both of the static eliminating section and the cleaning section may be omitted. In such a situation, the process cartridge can adopt a unitized configuration including, in addition to the photosensitive member, one or more selected from the group consisting of a charging section, a light exposure section, a developing section, and a transfer section. The charging section, the light exposure section, the developing section, the transfer section, the cleaning section, and the static eliminating section can have the same configurations as the charging section 27, the light exposure section 28, the developing section 29, the transfer section, the cleaning section, and the static eliminating section described above in the third embodiment.

Through the above, the process cartridge of the present embodiment has been explained. The process cartridge of the present embodiment includes the photosensitive member 1 of the first embodiment as an image bearing member. In a situation in which the process cartridge of the present embodiment, which includes a photosensitive member such as described above, is installed in the image forming apparatus 6, image defects resulting from a reduction in surface charge potential of the image bearing member can be inhibited. Furthermore, a process cartridge such as described above is easy to handle and can therefore be easily and quickly replaced, together with the photosensitive member 1, when sensitivity characteristics or the like of the photosensitive member 1 deteriorate.

Examples

The following provides more specific explanation of the present disclosure through use of Examples. However, note that the present disclosure is not limited to the scope of the Examples.

[1. Photosensitive Member Preparation]

Photosensitive members (A-1)-(A-25) and (B-1)-(B-6) were each prepared using a charge generating material (CGM), a hole transport material (HTM), an electron transport material (ETM), and a binder resin.

[1-1. Charge Generating Material]

Each of the photosensitive members (A-1)-(A-25) and (B-1)-(B-6) was prepared using one of the charge generating materials described below. More specifically, Y-form titanyl phthalocyanine crystals represented by chemical formula (CG-1) or α-form titanyl phthalocyanine crystals (CGM-D (α-TiOPc)) were used as shown in Tables 2 and 3. The Y-form titanyl phthalocyanine crystals that were used were Y-form titanyl phthalocyanine crystals (CGM-A) having a thermal characteristic (A), Y-form titanyl phthalocyanine crystals (CGM-B) having the thermal characteristic (B), or Y-form titanyl phthalocyanine crystals (CGM-C) having the thermal characteristic (C). Herein, the thermal characteristic (A) is a thermal characteristic measured by DSC in which at least one peak is present in a range from 50° C. to 270° C., other than a peak resulting from vaporization of adsorbed water. The following explains preparation methods of the charge generating materials.

[1-1-1. Y-Form Titanyl Phthalocyanine Crystals (CGM-C)]

Preparation of Y-form titanyl phthalocyanine crystals is explained using CGM-A and CGM-C as examples. A flask purged with argon was charged with 22 g (0.1 mol) of o-phthalonitrile, 25 g (0.073 mol) of titanium tetrabutoxide, 2.28 g (0.038 mol) of urea, and 300 g of quinoline, and was heated to 150° C. under stirring. Next, heating was performed to 215° C. while evaporating out of the reaction system vapor produced by the reaction system. Thereafter, stirring was performed for a further 2 hours to cause a reaction to occur while maintaining the reaction temperature at 215° C.

After the reaction, the resultant reaction mixture was removed from the flask after cooling to 150° C. and was filtered using a glass filter. The resultant solid was washed with DMF and methanol in order and was subsequently vacuum dried to yield 24 g of a bluish purple solid.

Next, 10 g of the prepared bluish purple solid was added to 100 mL of DMF, was heated to 130° C. under stirring, and was subjected to a further 2 hours of stirring. Heating was stopped after 2 hours passed and stirring was stopped after cooling to 23±1° C. The resultant liquid was left to stabilize for 12 hours in the state described above. Next, the stabilized liquid was filtered using a glass filter and the resultant solid was washed using methanol. Thereafter, the washed solid was vacuum dried to yield 9.83 g of crude crystals of a titanyl phthalocyanine compound.

Next, 5 g of the crude crystals of titanyl phthalocyanine were dissolved in 100 mL of concentrated sulfuric acid. The resultant solution was dripped into water under ice cooling and was then stirred for 15 minutes at room temperature. Thereafter, the solution was left to stand for 30 minutes at approximately 23±1° C. to cause recrystallization. Next, the liquid described above was filtered using a glass filter and the resultant solid was washed with water until the washings were neutral. Thereafter, the solid was dispersed in 200 mL of chlorobenzene without drying and in a state with water present, was heated to 50° C., and was stirred for 10 hours. After subsequently using a glass filter to separate liquid by filtration, the resultant solid was vacuum dried for 5 hours at 50° C. to yield 4.1 g of titanyl phthalocyanine crystals (blue powder).

(CuKα Characteristic X-Ray Diffraction Spectrum)

A CuKα characteristic X-ray diffraction spectrum of the prepared Y-form titanyl phthalocyanine crystals (CGM-C) was measured according to the X-ray diffraction spectrum measurement method described further above. The Bragg angle was determined from the measured X-ray diffraction spectrum. The prepared Y-form phthalocyanine crystals (CGM-C) exhibited a main peak at a Bragg angle 2θ±0.2°=27.2° in a CuKα characteristic X-ray diffraction spectral chart.

(Differential Scanning Calorimetry)

A differential scanning calorimetry spectrum of the prepared Y-form titanyl phthalocyanine crystals (CGM-C) was measured according to the differential scanning calorimetry spectrum measurement method explained further above. In a differential scanning calorimetry chart for the prepared Y-form titanyl phthalocyanine crystals (CGM-C), a peak was not observed in a range from 50° C. to 270° C., other than a peak resulting from vaporization of adsorbed water, and a peak was observed at 296° C. (i.e., in a range from 270° C. to 400° C.).

[1-1-2. Y-Form Titanyl Phthalocyanine Crystals (CGM-A)]

"OG-01H" produced by IT-chem Co, Ltd, was used as the Y-form titanyl phthalocyanine crystals (CGM-A). A CuKα characteristic X-ray diffraction spectrum of the Y-form titanyl phthalocyanine crystals (CGM-A) was measured according to the same method as the Y-form titanyl phthalocyanine crystals (CGM-C). The Y-form titanyl phthalocyanine exhibited peaks at Bragg angles 2θ±0.2°=9.2°, 14.5°, 18.1°, 24.1°, and 27.3° in a CuKα characteristic X-ray diffraction spectral chart.

(Differential Scanning Calorimetry)

Differential scanning calorimetry was performed for the Y-form titanyl phthalocyanine crystals (CGM-A) according to the same method as the Y-form titanyl phthalocyanine crystals (CGM-C). In a differential scanning calorimetry chart for the Y-form titanyl phthalocyanine crystals (CGM-A), one peak was observed in the range from 50° C. to 270° C. at 232° C., other than a peak resulting from vaporization of adsorbed water.

[1-1-3. α-Form Titanyl Phthalocyanine Crystals (CGM-D (α-TiOPc))]

First, 50 g (0.39 mol) of o-phthalonitrile and 750 mL of quinoline were added into a flask having a capacity of 2 L and were stirred under a nitrogen atmosphere while 42.5 g (0.22 mol) of titanium tetrachloride was added thereto. Thereafter, the internal temperature of the flask was raised to 200° C. and the flask contents were stirred for 5 hours at 200° C. to cause a reaction of the flask contents. After the reaction, filtration was performed under heating and washing was performed by sprinkling 500 mL of hot DMF to obtain a wet cake. The resultant wet cake was added into 300 mL of DMF and was stirred for 2 hours at 130° C. Next, hot filtration was performed at 130° C. and subsequently washing was performed using 500 mL of DMF. After the operation described above was repeated four times, the resultant wet cake was washed using 750 mL of methanol.

After being washed with methanol, the wet cake was dried under reduced pressure at 40° C. to yield crude synthetic titanyl phthalocyanine (yield: 43 g). Next, 400 g of concentrated sulfuric acid was cooled to 5° C. or lower in a methanol bath and 30 g (0.052 mol) of the crude synthetic titanyl phthalocyanine was added into the concentrated sulfuric acid while maintaining the temperature at 5° C. or lower. After 1 hour of stirring, the resultant reaction mixture was dripped into 10 L of water (5° C.) and mixing thereof was performed for 3 hours at room temperature. Thereafter, the resultant mixture was left to stand and was then filtered to obtain a wet cake.

Next, the resultant wet cake was added into 500 mL of water and filtration was performed after 1 hour of stirring at room temperature. The operation described above was repeated twice. Next, after the water washing, the wet cake was added into 5 L of water. After 1 hour of stirring at room temperature, the wet cake in the water was left to stand and was subsequently filtered. The operation described above was repeated twice. Thereafter, washing was performed using 2 L of ion exchanged water and the wet cake was collected once a pH of at least 6.2 and a conductivity of no greater than 20 μS were reached. The collected wet cake was dried to yield low-crystallinity phthalocyanine (blue powder, yield: 25 g). The low-crystallinity phthalocyanine exhibited peaks at Bragg angles 2θ±0.2°=7.0°, 15.6°, 23.5°, and 28.4° in a CuKα characteristic X-ray diffraction spectrum.

Next, 24 g of the low-crystallinity titanyl phthalocyanine, 400 mL of DMF, and an appropriate amount of glass beads (Ø1 mm) were added into a mayonnaise bottle having a capacity of 900 mL and were dispersed for 24 hours using a bead mill. Filtration was performed after separation of the glass beads. A cake resulting from filtration was washed using a mixed solution of 400 mL of DMF and 400 mL of methanol. The washed cake was dried for 48 hours under reduced pressure at 50° C. to yield a solid. The prepared solid was pulverized to yield α-form titanyl phthalocyanine crystals (yield: 21 g).

(CuKα Characteristic X-Ray Diffraction Spectrum)

A CuKα characteristic X-ray diffraction spectrum of the prepared α-form titanyl phthalocyanine crystals was measured according to the same method as the Y-form titanyl phthalocyanine crystals. The prepared α-form titanyl phthalocyanine crystals exhibited peaks at Bragg angles 2θ±0.2°=7.5°, 10.2°, 12.6°, 13.2°, 15.1°, 16.3°, 17.3°. 18.3°, 22.5°, 24.2°, 25.3°, and 28.6° in a CuKα characteristic X-ray diffraction spectral chart.

[1-2. Hole Transport Material]

The photosensitive members (A-1)-(A-25), (B-1), and (B-2) were prepared using the hole transport materials (HT-1), (HT-3), (HT-5), (HT-6), (HT-11), (HT-16)-(HT-18), (HT-22), (HT-23), (HT-30), (HT-31), (HT-35), (HT-40), (HT-47). (HT-54), and (HT-56) as shown in Tables 2 and 3 further below. Each of the hole transport materials is a compound represented by general formula (1) described in the first embodiment in which, in general formula (1), $R^1$, $R^2$, $R^3$, $R^4$, $R^5$, n1, and n2 are respectively $R^1$, $R^2$, $R^3$, $R^4$, $R^5$, n1, and n2 shown in Table 1 further below. The photosensitive members (B-3)-(B-6) were prepared using hole transport materials (HT-R1)-(HT-R4) as shown in Table 3. The hole transport materials (HT-R1)-(HT-R4) are respectively represented by chemical formulae (HT-R1)-(HT-R4) (also referred to below as (HT-R1)-(HT-R4) respectively).

(HT-R 1)

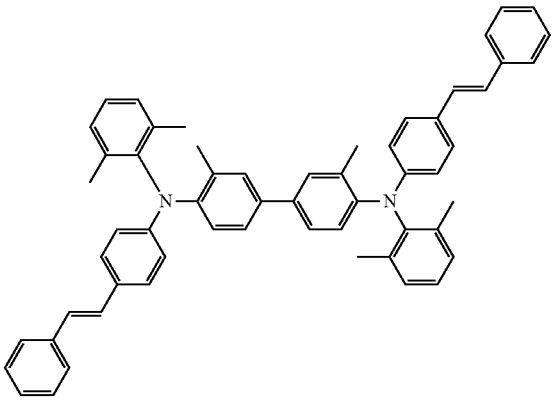

(HT-R 2)

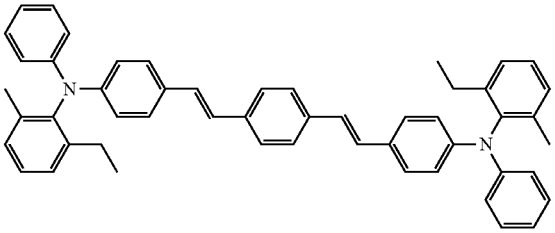

-continued (HT-R3)

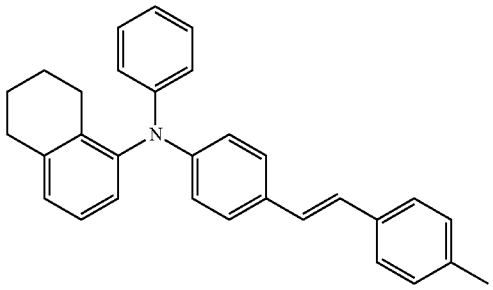

(HT-R4)

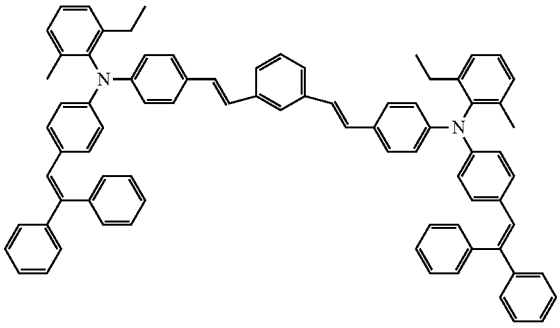

[1-3. Electron Transport Material]

Each of the photosensitive members (A-1)-(A-25) and (B-1)-(B-6) was prepared using one of the electron transport materials described below. More specifically, each of the photosensitive members was prepared using one of the compounds represented by chemical formulae (ET-1)-(ET-6) shown above in the first embodiment as shown in Tables 2 and 3.

[1-4. Binder Resin]

Each of the photosensitive members (A-1)-(A-25) and (B-1)-(B-6) was prepared using a resin including a repeating unit represented by general formula (Resin-1) (polycarbonate resin, viscosity average molecular weight 30.000).

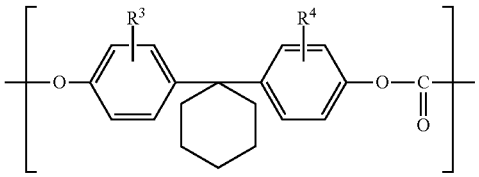

(Resin-1)

In general formula (Resin-1), $R^3$ and $R^4$ each represent a hydrogen atom.

[1-5. Preparation of Photosensitive Member (A-1)]

A ball mill vessel was charged with 2.2 parts by mass of the charge generating material (CGM-C), 60 parts by mass of the hole transport material (HT-1), 40 parts by mass of the electron transport material (ET-1), 100 parts by mass of the polycarbonate resin (Resin-1) as a binder resin, and 800 parts by mass of tetrahydrofuran. The vessel contents were mixed and dispersed for 50 hours using the ball mill to prepare an application liquid for photosensitive layer formation. The prepared application liquid for photosensitive layer formation was applied onto a conductive substrate by dip coating. The applied application liquid (applied film)

was heated for 60 minutes at 100° C. to remove tetrahydrofuran from the applied film. Through the above, the photosensitive member (A-1) was prepared as a single-layer photosensitive member. A photosensitive layer of the prepared photosensitive member (A-1) had a film thickness of 25 μm.

[1-6. Preparation of Photosensitive Members (A-2)-(A-25) and (B-1)-(B-6)]

The photosensitive members (A-2)-(A-25) and (B-1)-(B-6) were prepared according to the same method as the photosensitive member (A-1) in all aspects other than the changes described below. That is, the photosensitive members (A-2)-(A-25) and (B-1)-(B-6) were each prepared using a charge generating material, a hole transport material, and an electron transport material shown in Tables 2 and 3 further below instead of the charge generating material (CGM-C), the hole transport material (HT-1), and the electron transport material (ET-1) used in preparation of the photosensitive member (A-1).

[2. Evaluation of Photosensitive Member Properties]

[2-1. Evaluation of Ozone Resistance]

Each of the prepared photosensitive members was exposed to ozone and a change in charge potential before and after exposure was evaluated. More specifically, the photosensitive member was rotated four times while being charged under conditions of a current of 8 μA (rotation speed 31 rpm) using a drum sensitivity test device (product of Gen-Tech, Inc.) and an average surface potential for the four rotations was calculated. The calculated average surface potential was taken to be an initial charge potential $V_A0$.

Next, the photosensitive member was exposed to an atmosphere with an ozone concentration of 8 ppm in the dark for 6 hours at room temperature (25° C.). The surface potential of the photosensitive member was measured straight after exposure and an average surface potential was calculated as a charge potential $V_A$ straight after exposure. Note that the initial charge potential $V_A0$ and the charge potential $V_A$ straight after exposure were measured at a temperature of 23° C. and a relative humidity of 50%.

Next, $\Delta V_A0$ was calculated using mathematical formula (2) and ozone resistance of the photosensitive member was evaluated in accordance with the following standard. Note that a small value for $\Delta V_A0$ was determined to indicate better ozone resistance for the photosensitive member. Among the evaluation grades shown below (ozone resistance evaluation grades A-E), ozone resistance evaluation grades A-D were considered to pass evaluation. The obtained results are shown in Tables 2 and 3.

$$\text{Initial charge potential } V_A0 - \text{Charge potential } V_A \text{ straight after exposure} = \Delta V_A0 \quad (2)$$

Ozone resistance evaluation grade A: $\Delta V_A0$ of less than 20 V

Ozone resistance evaluation grade B: $\Delta V_A0$ of at least 20 V and less than 30 V Ozone resistance evaluation grade C: $\Delta V_A0$ of at least 30 V and less than 40 V Ozone resistance evaluation grade D: $\Delta V_A0$ of at least 40 V and less than 49 V Ozone resistance evaluation grade E: $\Delta V_A0$ of at least 49 V

[2-2. Evaluation of Repeated Use Characteristic]

Each of the prepared photosensitive members was subjected to alternately repeated charging and light exposure, and a change in charge potential before and after was evaluated. The photosensitive member was charged to +700 V under conditions of a rotation speed of 100 rpm (process speed 157 mms) using the drum sensitivity test device (product of Gen-Tech, Inc.) and a surface potential of the photosensitive member was measured. Next, a band pass filter was used to obtain monochromatic light (wavelength 780 nm, half-width 20 nm, light intensity 0.2 μJ/cm$^2$) from light emitted by a halogen lamp and the surface of the photosensitive member was irradiated with (i.e., exposed to) the obtained monochromatic light.

A durability test was performed in which 1.000 sets of alternate repetitions of charging and light exposure described above were carried out for one rotation each. The surface potential of the sample (photosensitive member) was measured during the durability test. More specifically, an average surface potential during charging of a $10^{th}$ set was taken to be an initial charge potential $V_B0$ [V]. An average surface potential during charging of a 1,000 set was taken to be a charge potential $V_B$ [V] after repeated use. Note that the initial charge potential $V_B0$ and the charge potential $V_B$ after repeated use were measured at a temperature of 23° C. and a relative humidity of 50%.

Next, $\Delta V_B0$ was calculated using mathematical formula (3) and a repeated use characteristic was evaluated in accordance with the following standard. Note that a small value for $\Delta V_B0$ was determined to indicate a better repeated use characteristic for the photosensitive member. Among the evaluation grades shown below (repeated use characteristic evaluation grades A-E), repeated use characteristic evaluation grades A-D were considered to pass evaluation. The obtained results are shown in Tables 2 and 3.

$$\text{Initial charge potential } V_B0 - \text{Charge potential } V_B \text{ after repeated use} = \Delta V_B0 \quad (3)$$

Repeated use characteristic evaluation grade A: $\Delta V_B0$ of less than 20 V

Repeated use characteristic evaluation grade B: $\Delta V_B0$ of at least 20 V and less than 30 V Repeated use characteristic evaluation grade C: $\Delta V_B0$ of at least 30 V and less than 40 V Repeated use characteristic evaluation grade D: $\Delta V_B0$ of at least 40 V and less than 50 V Repeated use characteristic evaluation grade E: $\Delta V_B0$ of at least 50 V

[2-3. Overall Evaluation]

An overall evaluation of the above evaluations was performed in accordance with the following standard. The obtained results are shown in Tables 2 and 3. Among overall evaluation grades A-E, overall evaluation grades A-D were classified as good and overall evaluation grade E was classified as poor.

Overall evaluation grade A: Grade A for both ozone resistance and repeated use characteristic evaluation Overall evaluation grade B: Grade B for both ozone resistance and repeated use characteristic evaluation or grade A for one evaluation and grade B for the other Overall evaluation grade C: Grade C for both ozone resistance and repeated use characteristic evaluation or grade B for one evaluation and grade C for the other Overall evaluation grade D: Grade D for both ozone resistance and repeated use characteristic evaluation or grade C for one evaluation and grade D for the other Overall evaluation grade E: Grade E for both ozone resistance and repeated use characteristic evaluation Tables 2 and 3 shown details of the materials contained in the photosensitive layer of each of the photosensitive members (A-1)-(A-25) and (B-1)-(B-6). Tables 2 and 3 also show evaluation results of the properties of the photosensitive members (A-1)-(A-25) and (B-1)-(B-6).

TABLE 1

| HTM | $R^1$ | $R^2$ | $R^3$ | $R^4$ | $R^5$ | n1 | n2 |
|---|---|---|---|---|---|---|---|
| HT-1 | H— | H— | H— | H— | H— | 0 | 0 |
| HT-3 | H— | p-$CH_3$— | H— | p-$CH_3$— | H— | 0 | 0 |
| HT-5 | H— | p-$CH_3$— | p-$CH_3$— | p-$CH_3$— | p-$CH_3$— | 0 | 0 |
| HT-6 | H— | m-$CH_3$— | H— | m-$CH_3$— | H— | 0 | 0 |
| HT-11 | H— | p-$CH_3O$— | H— | p-$CH_3O$— | H— | 0 | 0 |
| HT-16 | p-$CH_3$— | H— | H— | H— | H— | 0 | 0 |
| HT-17 | p-$CH_3$— | p-$CH_3$— | H— | p-$CH_3$— | H— | 0 | 0 |
| HT-18 | p-$CH_3$— | p-$CH_3$— | p-$CH_3$— | p-$CH_3$— | p-$CH_3$— | 0 | 0 |
| HT-22 | p-$CH_3$— | p-$C_2H_5$— | p-$C_2H_5$— | p-$C_2H_5$— | p-$C_2H_5$— | 0 | 0 |
| HT-23 | p-$CH_3$— | p-$CH_3O$— | H— | p-$CH_3O$— | H— | 0 | 0 |
| HT-30 | p-$C_2H_5$— | p-$CH_3$— | p-$CH_3$— | p-$CH_3$— | p-$CH_3$— | 0 | 0 |
| HT-31 | p-$C_2H_5$— | p-$C_2H_5$— | p-$C_2H_5$— | p-$C_2H_5$— | p-$C_2H_5$— | 0 | 0 |
| HT-35 | p-n-$C_4H_9$— | p-$CH_3$— | p-$CH_3$— | p-$CH_3$— | p-$CH_3$— | 0 | 0 |
| HT-40 | p-$CH_3O$— | p-$CH_3$— | p-$CH_3$— | p-$CH_3$— | p-$CH_3$— | 0 | 0 |
| HT-47 | p-$CH_3$— | p-$CH_3$— | p-$CH_3$— | p-$CH_3$— | p-$CH_3$— | 1 | 1 |
| HT-54 | p-$CH_3O$— | p-$CH_3$— | p-$CH_3$— | p-$CH_3$— | p-$CH_3$— | 1 | 1 |
| HT-56 | p-$CH_3$— | p-$CH_3$— | p-$CH_3$— | p-$CH_3$— | p-$CH_3$— | 0 | 1 |

TABLE 2

| | Photosensitive | CGM | HTM | | ETM | Ozone resistance | | Repeated use characteristic | | Overall |
|---|---|---|---|---|---|---|---|---|---|---|
| | member | Type | Type | Parts | Type | $\Delta V_A 0$ | Grade | $\Delta V_B 0$ | Grade | grade |
| Example 1 | A-1 | CGM-C | HT-1 | 60 | ET-1 | 38 | C | 32 | C | C |
| Example 2 | A-2 | CGM-C | HT-3 | 60 | ET-1 | 36 | C | 32 | C | C |
| Example 3 | A-3 | CGM-C | HT-5 | 60 | ET-1 | 31 | C | 29 | B | C |
| Example 4 | A-4 | CGM-C | HT-6 | 60 | ET-1 | 34 | C | 31 | C | C |
| Example 5 | A-5 | CGM-C | HT-11 | 60 | ET-1 | 30 | C | 25 | B | C |
| Example 6 | A-6 | CGM-C | HT-16 | 60 | ET-1 | 29 | B | 23 | B | B |
| Example 7 | A-7 | CGM-C | HT-17 | 60 | ET-1 | 27 | B | 27 | B | B |
| Example 8 | A-8 | CGM-C | HT-18 | 60 | ET-1 | 24 | B | 25 | B | B |
| Example 9 | A-9 | CGM-C | HT-22 | 60 | ET-1 | 25 | B | 23 | B | B |
| Example 10 | A-10 | CGM-C | HT-23 | 60 | ET-1 | 29 | B | 32 | C | C |
| Example 11 | A-11 | CGM-C | HT-30 | 60 | ET-1 | 26 | B | 28 | B | B |
| Example 12 | A-12 | CGM-C | HT-31 | 60 | ET-1 | 28 | B | 26 | B | B |
| Example 13 | A-13 | CGM-C | HT-35 | 60 | ET-1 | 31 | C | 32 | C | C |
| Example 14 | A-14 | CGM-C | HT-40 | 60 | ET-1 | 24 | B | 26 | B | B |
| Example 15 | A-15 | CGM-C | HT-47 | 60 | ET-1 | 33 | C | 30 | C | C |
| Example 16 | A-16 | CGM-C | HT-54 | 60 | ET-1 | 38 | C | 35 | C | C |
| Example 17 | A-17 | CGM-C | HT-56 | 60 | ET-1 | 22 | B | 21 | B | B |
| Example 18 | A-18 | CGM-C | HT-5 | 60 | ET-3 | 23 | B | 19 | A | B |

TABLE 3

| | Photosensitive | CGM | HTM | | ETM | Ozone resistance | | Repeated use characteristic | | Overall |
|---|---|---|---|---|---|---|---|---|---|---|
| | member | Type | Type | Parts | Type | $\Delta V_A 0$ | Grade | $\Delta V_B 0$ | Grade | grade |
| Example 19 | A-19 | CGM-C | HT-5 | 60 | ET-2 | 33 | C | 26 | B | C |
| Example 20 | A-20 | CGM-C | HT-5 | 60 | ET-6 | 77 | B | 31 | C | C |
| Example 21 | A-21 | CGM-C | HT-5 | 60 | ET-5 | 36 | C | 42 | D | D |
| Example 22 | A-22 | CGM-C | HT-5 | 60 | ET-4 | 18 | A | 17 | A | A |
| Example 23 | A-23 | CGM-B | HT-5 | 60 | ET-1 | 42 | D | 45 | D | D |
| Example 24 | A-24 | CGM-B | HT-18 | 60 | ET-3 | 39 | C | 43 | D | D |
| Example 25 | A-25 | CGM-B | HT-1/HT-18 | 30/30 | ET-1 | 29 | B | 26 | B | B |
| Comparative Example 1 | B-1 | CGM-D (α-TiOPc) | HT-5 | 60 | ET-1 | 80 | E | 84 | E | E |
| Comparative Example 2 | B-2 | CGM-A | HT-5 | 60 | ET-1 | 65 | E | 66 | E | E |
| Comparative Example 3 | B-3 | CGM-C | HT-R1 | 60 | ET-1 | 54 | E | 57 | E | E |
| Comparative Example 4 | B-4 | CGM-C | HT-R2 | 60 | ET-1 | 52 | E | 50 | E | E |
| Comparative Example 5 | B-5 | CGM-C | HT-R3 | 60 | ET-1 | 49 | E | 59 | E | E |
| Comparative Example 6 | B-6 | CGM-C | HT-R4 | 60 | ET-1 | 74 | E | 70 | E | E |

As clearly shown by Tables 2 and 3, the photosensitive members of the Examples had ozone resistance evaluation grades A-D. The photosensitive members of the Comparative Examples each had an ozone resistance evaluation grade E. The above shows that the photosensitive members of the Examples had excellent ozone resistance compared to the photosensitive members of the Comparative Examples. Furthermore, the photosensitive members of the Examples had repeated use characteristic evaluation grades A-D. The photosensitive members of the Comparative Examples each had a repeated use characteristic evaluation grade E. The above shows that the photosensitive members of the Examples had excellent repeated use characteristics compared to the photosensitive members of the Comparative Examples. The photosensitive members of the Examples had overall evaluations grades A-D. The photosensitive members of the Comparative Examples each had an overall evaluation grade E. The above shows that the photosensitive members according to the present disclosure had excellent ozone resistance and repeated use characteristics.

What is claimed is:

1. An electrophotographic photosensitive member comprising:

a conductive substrate; and a photosensitive layer located either directly or indirectly on the conductive substrate, wherein the photosensitive layer has a single-layer structure, the photosensitive layer contains at least a charge generating material, a hole transport material, an electron transport material, and only one binder resin in the same layer, the charge generating material includes titanyl phthalocyanine, the titanyl phthalocyanine exhibits a main peak at a Bragg angle 2θ±0.2°=27.2° in a CuKα characteristic X-ray diffraction spectrum and satisfies either (B) or (C), shown below, in a differential scanning calorimetry spectrum:

(B) a peak is not present in a range from 50° C. to 400° C., other than a peak resulting from vaporization of adsorbed water;

(C) a peak is not present in a range from 50° C. to 270° C., other than a peak resulting from vaporization of adsorbed water, and a peak is present in a range from 270° C. to 400° C., the hole transport material includes at least one compound represented by general formula (1) shown below, and the at least one compound represented by the general formula (1) is a compound (HT-5), (HT-16), (HT-17), (HT-18), (HT-22), (HT-30), (HT-31), (HT-40), or (HT-56) shown below, or compounds (HT-1) and (HT-18) shown below (1)

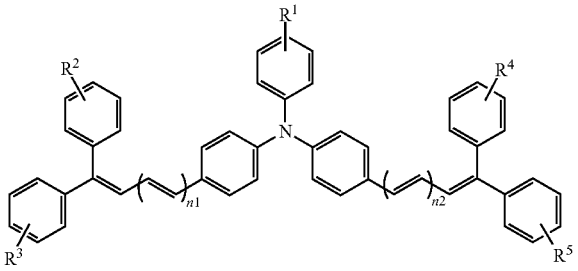

(HT-1): in the general formula (1), $R^1$, $R^2$, $R^3$, $R^4$, and $R^5$ each represent a hydrogen atom, and n1 and n2 each represent 0, (HT-5): in the general formula (1), $R^1$ represents a hydrogen atom, $R^2$, $R^3$, $R^4$, and $R^5$ each represent a para-methyl group, and n1 and n2 each represent 0, (HT-16): in the general formula (1), $R^1$ represents a para-methyl group, $R^2$, $R^3$, $R^4$, and $R^5$ each represent a hydrogen atom, and n1 and n2 each represent 0, (HT-17): in the general formula (1), $R^1$, $R^2$, and $R^4$ each represent a para-methyl group, $R^3$ and $R^5$ each represent a hydrogen atom, and n1 and n2 each represent 0, (HT-18): in the general formula (1), $R^1$, $R^2$, $R^3$, $R^4$, and $R^5$ each represent a para-methyl group, and n1 and n2 each represent 0, (HT-22): in the general formula (1), $R^1$ represents a para-methyl group, $R^2$, $R^3$, $R^4$, and $R^5$ each represent a para-ethyl group, and n1 and n2 each represent 0, (HT-30): in the general formula (1), $R^1$ represents a para-ethyl group, $R^2$, $R^3$, $R^4$, and $R^5$ each represent a para-methyl group, and n1 and n2 each represent 0, (HT-31): in the general formula (1), $R^1$, $R^2$, $R^3$, $R^4$, and $R^5$ each represent a para-ethyl group, and n1 and n2 each represent 0, (HT-40): in the general formula (1), $R^1$ represents a para-methoxy group, $R^2$, $R^3$, $R^4$, and $R^5$ each represent a para-methyl group, and n1 and n2 each represent 0, (HT-56): in the general formula (1), $R^1$, $R^2$, $R^3$, $R^4$, and $R^5$ each represent a para-methyl group, n1 represents 0, and n2 represents 1.

2. The electrophotographic photosensitive member according to claim 1, wherein the titanyl phthalocyanine does not exhibit a peak at a Bragg angle 2θ±0.2°=26.2° in the CuKα characteristic X-ray diffraction spectrum.

3. The electrophotographic photosensitive member according to claim 1, wherein the photosensitive layer further includes at least one of tetrahydrofuran and toluene.

4. A process cartridge comprising the electrophotographic photosensitive member according to claim 1.

5. An image forming apparatus comprising:

an image bearing member;

a charging section that charges a surface of the image bearing member;

a light exposure section that forms an electrostatic latent image on the surface of the image bearing member by exposing the surface of the image bearing member to light after the surface of the image bearing member is charged by the charging section;

a developing section that develops the electrostatic latent image into a toner image; and a transfer section that transfers the toner image onto a transfer target from the image bearing member, wherein the charging section has a positive charging polarity, and the image bearing member is the electrophotographic photosensitive member according to claim 1.

6. The image forming apparatus according to claim 5, wherein after transfer to the transfer target is complete for a given region of the image bearing member, the region of the image bearing member is recharged by the charging section without being subjected to static elimination or blade cleaning, or after being subjected to only one of static elimination and blade cleaning, and a process speed of the image bearing member is at least 120 mm/s.

7. The electrophotographic photosensitive member according to claim 1, wherein the electron transport material includes a compound represented by chemical formula (ET-3) or (ET-4) shown below.

(ET-3)

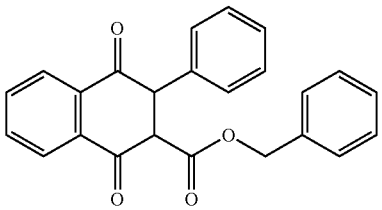

-continued (ET-4)

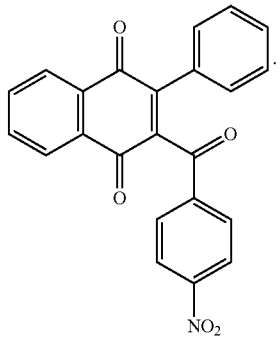

8. The electrophotographic photosensitive member according to claim 1, wherein in the general formula (1), $R^1$, $R^2$, $R^3$, $R^4$, and $R^5$ each represent a para-methyl group, n1 represents 0, and n2 represents 1.

9. The electrophotographic photosensitive member according to claim 1, wherein the titanyl phthalocyanine satisfies (C) shown above, in the differential scanning calorimetry spectrum.

* * * * *